US010835901B2

(12) United States Patent
Shin et al.

(10) Patent No.: US 10,835,901 B2
(45) Date of Patent: Nov. 17, 2020

(54) APPARATUSES, SYSTEMS AND METHODS FOR PROVIDING THERMOCYCLER THERMAL UNIFORMITY

(71) Applicant: Life Technologies Corporation, Carlsbad, CA (US)

(72) Inventors: Hon Siu Shin, Singapore (SG); Chin Yong Koo, Singapore (SG); Way Xuang Lee, Singapore (SG); Chee Kiong Lim, Singapore (SG); Chee Wee Ching, Johor Bahru (MY); Niroshan Ramachandran, San Marcos, CA (US)

(73) Assignee: LIFE TECHNOLOGIES CORPORATION, Carlsbad, CA (US)

( * ) Notice: Subject to any disclaimer, the term of this patent is extended or adjusted under 35 U.S.C. 154(b) by 338 days.

(21) Appl. No.: 15/640,241

(22) Filed: Jun. 30, 2017

(65) Prior Publication Data

US 2018/0056296 A1 Mar. 1, 2018

Related U.S. Application Data

(63) Continuation of application No. 14/917,400, filed as application No. PCT/US2014/055615 on Sep. 15, 2014, now abandoned.

(Continued)

(51) Int. Cl.
*B01L 7/00* (2006.01)
*B01L 99/00* (2010.01)

(52) U.S. Cl.
CPC ..... *B01L 7/52* (2013.01); *B01L 2200/147* (2013.01); *B01L 2300/0829* (2013.01);
(Continued)

(58) Field of Classification Search
CPC ..... B01L 2200/147; B01L 2300/0829; B01L 2300/0848; B01L 2300/0887; B01L 2300/12; B01L 2300/1822; B01L 7/52
See application file for complete search history.

(56) References Cited

U.S. PATENT DOCUMENTS 3,036,893 A 5/1962 Natelson
3,128,239 A 4/1964 Page
(Continued)

FOREIGN PATENT DOCUMENTS

CN 102892508 1/2013
CN 103003448 3/2013
(Continued)

OTHER PUBLICATIONS

"Cooling Machine CPU Cooler, Thermaltake,", printed from http://www.thermaltake.com/coolers/4in1_heatpipe/cl-pO114bigtyphoon/cl-pO114.htm, Copyright 2003., May 8, 2006, 1-2.
(Continued)

*Primary Examiner* — Gautam Prakash
*Assistant Examiner* — Lydia Edwards
(74) *Attorney, Agent, or Firm* — Jones Robb, PLLC

(57) ABSTRACT

A thermal block assembly including a sample block and two or more thermoelectric devices, is disclosed. The sample block has a top surface configured to receive a plurality of reaction vessels and an opposing bottom surface. The thermoelectric devices are operably coupled to the sample block, wherein each thermoelectric device includes a housing for a thermal sensor and a thermal control interface with a controller. Each thermoelectric device is further configured to operate independently from each other to provide a substantially uniform temperature profile throughout the sample block.

16 Claims, 19 Drawing Sheets

Related U.S. Application Data

(60) Provisional application No. 61/878,464, filed on Sep. 16, 2013.

(52) U.S. Cl.
CPC ..... *B01L 2300/0848* (2013.01); *B01L 2300/0887* (2013.01); *B01L 2300/12* (2013.01); *B01L 2300/1822* (2013.01)

(56) References Cited

U.S. PATENT DOCUMENTS

| | | | |
|---|---|---|---|
| 3,216,804 | A | 11/1965 | Natelson |
| 3,260,413 | A | 7/1966 | Natelson |
| 3,261,668 | A | 7/1966 | Natelson |
| 3,271,112 | A | 9/1966 | Williams et al. |
| 3,331,665 | A | 7/1967 | Natelson |
| 3,368,872 | A | 2/1968 | Natelson |
| 3,556,731 | A | 1/1971 | Martin |
| 4,865,986 | A | 9/1989 | Coy et al. |
| 4,950,608 | A | 8/1990 | Kishimoto et al. |
| 5,038,852 | A | 8/1991 | Johnson et al. |
| 5,061,630 | A | 10/1991 | Knopf et al. |
| 5,224,536 | A | 7/1993 | Eigen et al. |
| 5,333,675 | A | 8/1994 | Mullis et al. |
| 5,430,957 | A | 7/1995 | Eigen et al. |
| 5,441,576 | A | 8/1995 | Bierschenk et al. |
| 5,475,610 | A | 12/1995 | Atwood et al. |
| 5,504,007 | A | 4/1996 | Haynes |
| 5,525,300 | A | 6/1996 | Danssaert et al. |
| 5,601,141 | A | 2/1997 | Gordon et al. |
| 5,602,756 | A | 2/1997 | Atwood |
| 5,656,493 | A | 8/1997 | Mullis et al. |
| 5,716,842 | A | 2/1998 | Baier et al. |
| 5,802,856 | A | 9/1998 | Schaper et al. |
| 5,819,842 | A | 10/1998 | Potter et al. |
| 5,871,908 | A | 2/1999 | Henco et al. |
| 5,874,667 | A * | 2/1999 | Kasman ..... G01N 25/04 374/16 |
| 6,015,534 | A | 1/2000 | Atwood |
| 6,093,370 | A | 7/2000 | Yasuda et al. |
| 6,106,784 | A | 8/2000 | Lund et al. |
| 6,337,435 | B1 | 1/2002 | Chu et al. |
| 6,525,550 | B2 | 2/2003 | Pan |
| 6,558,947 | B1 | 5/2003 | Lund et al. |
| 6,633,785 | B1 | 10/2003 | Kasahara et al. |
| 6,767,512 | B1 | 7/2004 | Lurz et al. |
| 6,814,934 | B1 | 11/2004 | Higuchi et al. |
| 6,825,047 | B1 | 11/2004 | Woudenberg et al. |
| 7,611,674 | B2 | 11/2009 | Heimberg et al. |
| 7,727,479 | B2 | 6/2010 | Wolfgang et al. |
| 8,389,288 | B2 | 3/2013 | Heimberg et al. |
| 8,676,383 | B2 | 3/2014 | Tan et al. |
| 8,721,972 | B2 | 5/2014 | Heimberg et al. |
| 9,457,351 | B2 | 10/2016 | Tan et al. |
| 9,566,583 | B2 | 2/2017 | Conner et al. |
| 10,137,452 | B2 | 11/2018 | Conner et al. |
| 10,471,431 | B2 | 11/2019 | Lim et al. |
| 2001/0001644 | A1 | 5/2001 | Coffman et al. |
| 2002/0001848 | A1 | 1/2002 | Bedingham et al. |
| 2002/0068357 | A1 | 6/2002 | Mathies et al. |
| 2003/0214994 | A1 | 11/2003 | Schicke et al. |
| 2004/0065655 | A1 | 4/2004 | Brown et al. |
| 2004/0076996 | A1 | 4/2004 | Kondo et al. |
| 2004/0122559 | A1 | 6/2004 | Young et al. |
| 2004/0108288 | A1 | 12/2004 | Shin et al. |
| 2004/0241048 | A1 | 12/2004 | Shin et al. |
| 2005/0009070 | A1 * | 1/2005 | Arciniegas ..... B01L 3/50851 435/6.11 |
| 2005/0133724 | A1 | 6/2005 | Hsieh |
| 2005/0247357 | A1 | 11/2005 | Welle |
| 2006/0001644 | A1 | 1/2006 | Arakawa et al. |
| 2006/0024816 | A1 | 2/2006 | Fawcett et al. |
| 2006/0228268 | A1 | 10/2006 | Heimberg et al. |
| 2007/0054568 | A1 | 3/2007 | Roset |
| 2008/0026483 | A1 | 1/2008 | Oldenburg |
| 2008/0087316 | A1 | 4/2008 | Inaba et al. |
| 2008/0176292 | A1 | 7/2008 | Ugaz et al. |
| 2008/0116184 | A1 | 9/2008 | Lim et al. |
| 2008/0274511 | A1 | 11/2008 | Tan et al. |
| 2009/0155765 | A1 | 6/2009 | Atwood et al. |
| 2009/0325277 | A1 | 12/2009 | Shigeura et al. |
| 2010/0081191 | A1 | 4/2010 | Woods |
| 2010/0116896 | A1 | 5/2010 | Goemann-Thoss et al. |
| 2010/0120099 | A1 | 5/2010 | Heimberg et al. |
| 2010/0120100 | A1 | 5/2010 | Heimberg et al. |
| 2010/0124766 | A1 | 5/2010 | Ng et al. |
| 2010/0165784 | A1 | 7/2010 | Jovanovich et al. |
| 2011/0124918 | A1 | 10/2011 | Webster et al. |
| 2011/0275055 | A1 | 11/2011 | Conner et al. |
| 2013/0157376 | A1 | 6/2013 | Nay |

FOREIGN PATENT DOCUMENTS

| | | | |
|---|---|---|---|
| CN | 102483642 | A | 12/2014 |
| DE | 1900279 | | 9/1969 |
| DE | 19646115 | A1 | 5/1998 |
| DE | 102007003754 | | 7/2008 |
| EP | 0089383 | A1 | 9/1983 |
| EP | 0488769 | A2 | 6/1992 |
| EP | 0545736 | A2 | 6/1993 |
| EP | 0776967 | A2 | 6/1997 |
| EP | 0812621 | A1 | 12/1997 |
| JP | 2000-102376 | | 4/2000 |
| JP | 2001-275652 | | 10/2001 |
| JP | 2010502228 | | 1/2010 |
| JP | 2012-170337 | | 9/2012 |
| RU | 2106007 | | 2/1998 |
| WO | WO-1989/012502 | A1 | 12/1989 |
| WO | WO-1990/005947 | A1 | 5/1990 |
| WO | WO-1992/004979 | A1 | 4/1992 |
| WO | WO-1995/011294 | A1 | 4/1995 |
| WO | WO-1998/020975 | A1 | 5/1998 |
| WO | WO-1998/043740 | | 10/1998 |
| WO | WO-1999/016549 | | 4/1999 |
| WO | WO-2001/024930 | A1 | 4/2001 |
| WO | WO-2004/105947 | | 12/2004 |
| WO | WO-2004/108288 | | 12/2004 |
| WO | WO-2007/146443 | | 12/2007 |
| WO | WO-2008/030914 | | 3/2008 |
| WO | WO-2008/070198 | | 6/2008 |
| WO | WO-2008/116184 | | 9/2008 |
| WO | WO-2009/094061 | | 7/2009 |
| WO | WO-2010012494 | A1 | 2/2010 |
| WO | WO-2011/124918 | | 10/2011 |
| WO | WO-2011127386 | A2 | 10/2011 |
| WO | WO-2012/073484 | | 6/2012 |
| WO | WO-2012/080746 | | 6/2012 |
| WO | WO-2013133725 | A1 | 9/2013 |
| WO | WO-2015039014 | A1 | 3/2015 |

OTHER PUBLICATIONS

"CoolerMaster Expand Your Imagination, Hyper 6 (KHC-V81)", printed from http://www.coolermaster.com/index.php?LT=english&Language_s=2&url_place=product&pserial=KHC-V81&oth, May 8, 2006, 1-5.

"LightCycler® 480 System Rapid by Nature—Accurate by Design", brochure, *Roche Diagnostics*, printed from www.roche-applied-science.com,, Nov. 3, 2009, 16.

"Stratagene", *Quantitative PCR Systems*, May 2006, 1-12.

Cheng, J.Y., et al., "Performing Microchannel Temperature Cycling Reactions Using Reciprocating Reagent Shuttling Along a Radial Temperature Gradient", 2005, 931-940.

PCT/US2014/055615, "International Preliminary Report on Patentability", dated Mar. 31, 2016, 17 pp.

PCT/US2014/055615, "International Search Report and Written Opinion", dated Mar. 3, 2015, 24 pp.

Pogfai, T., et al., "Low Cost and Portable PCR Thermoelectric Cycle", *International Journal of Applied Biomedical Engineering*, 2008, 41-45.

(56) References Cited

OTHER PUBLICATIONS

EP11766806.1, "Extended European Search Report for Application No. 11766806.1 dated Nov. 5, 2013", dated Nov. 5, 2013, 1-5.
PCT/US2011/031750, "International Preliminary Examination Report on Patentability dated Oct. 9, 2012", dated Oct. 9, 2012, 1-4.
Extended European Search Report for Application No. 18180197.1, dated Aug. 2, 2018, 5 pages.
PCT/US2015/014357, International Search Report and Written Opinion dated Apr. 29, 2015, 15 pages.
Eppendorf—Mastercycler nexus, Service Manual 2016.

* cited by examiner

DETAIL A

Clydesdale Dual 96w Block TNU (No Edge Heaters)
Block 1

No EH: Upramp TNU of Left Block
(TNU: 0.53C)

No EH: Downramp TNU of Left Block
(TNU: 0.35C)

Clydesdale Dual 96w Block TNU (No Edge Heaters)
Block 2

No EH: Upramp TNU of Right Block
(TNU: 0.43C)

No EH: Downramp TNU of Right Block
(TNU: 0.46C)

Clydesdale Dual 96w Block TNU (With Edge Heaters)

Block 1

Optimized EH: Upramp TNU of Left Block (TNU: 0.26C)

Optimized EH: Downramp TNU of Left Block (TNU: 0.24C)

Clydesdale Dual 96w Block TNU (With Edge Heaters)
Block 2

Optimized EH: Upramp TNU of Right Block
(TNU: 0.28C)

Optimized EH: Downramp TNU of Right Block
(TNU: 0.29C)

Clydesdale Dual Flat Block TNU (No Edge Heaters)

Block 1

No EH: Upramp TNU of Left Block (TNU: 0.62C)

No EH: Downramp TNU of Left Block (TNU: 0.23C)

Clydesdale Dual Flat Block TNU (No Edge Heaters)

Block 2

No EH: Upramp TNU of Right Block (TNU: 0.73C)

No EH: Downramp TNU of Right Block (TNU: 0.17C)

Clydesdale Dual Flat Block TNU (With Edge Heaters)

Block 1

Optimized EH: Upramp TNU of Left Block
(TNU: 0.24C)

Optimized EH: Downramp TNU of Left Block
(TNU: 0.22C)

Clydesdale Dual Flat Block TNU (With Edge Heaters)
Block 2

Optimized EH: Upramp TNU of Right Block
(TNU: 0.32C)

Optimized EH: Downramp TNU of Right Block
(TNU: 0.15)

Legacy 9700 Dual 96w Block TNU (With Edge Heaters)
Block 1
Legacy 9700 Dual 96w Block (S/N:2971222840)
Upramp TNU of Left Block (TNU:0.47°C)

Legacy 9700 Dual 96w Block (S/N:2971222840)
Downramp TNU of Left Block (TNU:0.41°C)

Legacy 9700 Dual 96w Block TNU (With Edge Heaters)
Block 2
Legacy 9700 Dual 96w Block (S/N:2971222840)
Upramp TNU of Left Block (TNU:0.49°C)

Temperature setpoint for upramp TNU is 95C

Legacy 9700 Dual 96w Block (S/N:2971222840)
Downramp TNU of Right Block (TNU:0.43°C)

Temperature setpoint for downramp TNU is 60C

APPARATUSES, SYSTEMS AND METHODS FOR PROVIDING THERMOCYCLER THERMAL UNIFORMITY

CROSS REFERENCE TO RELATED APPLICATION

This application claims priority to U.S. application No. 61/878,464, filed Sep. 16, 2013, which disclosures are herein incorporated by reference in their entirety.

FIELD

The present disclosure generally relates to apparatuses, systems and methods for thermocycler devices.

BACKGROUND

Thermal cycling in support of Polymerase Chain Reaction (PCR) is a ubiquitous technology found in over 90% of molecular biology laboratories worldwide.

To amplify DNA (Deoxyribose Nucleic Acid) using the PCR process, involves cycling a specially constituted liquid reaction mixture through several different temperature incubation periods. The reaction mixture is comprised of various components including the DNA to be amplified and at least two primers sufficiently complementary to the sample DNA to be able to create extension products of the DNA being amplified. A key to PCR is the concept of thermal cycling: alternating steps of denaturing DNA, annealing short primers to the resulting single strands, and extending those primers to make new copies of double-stranded DNA. In thermal cycling the PCR reaction mixture is repeatedly cycled from high temperatures of around 95° C. for denaturing the DNA, to lower temperatures of approximately 50° C. to 70° C. for primer annealing and extension.

In some previous automated PCR instruments, sample tubes are inserted into sample wells on a metal block. To perform the PCR process, the temperature of the metal block is cycled according to prescribed temperatures and times specified by the user in a PCR protocol. The cycling is controlled by a computer and associated electronics. As the metal block changes temperature, the samples in the various tubes experience similar changes in temperature. However, in these previous instruments differences in sample temperature can be generated by non-uniformity of temperature from region to region within the sample metal block. Temperature gradients exist within the material of the block, causing some samples placed on the block to have different temperatures than others at particular times in the cycle. These differences in temperature and delays in heat transfer can cause the yield of the PCR process to differ from sample vial to sample vial. To perform the PCR process successfully and efficiently and to enable specialized applications (such as quantitative PCR), these temperature errors must be minimized as much as possible. The problems of minimizing non-uniformity in temperature at various points on the sample block become particularly acute when the size of the region containing samples becomes large as in a standard 8 by 12 microtiter plate.

SUMMARY

Apparatuses, systems, and methods for providing thermal uniformity throughout a thermocycler sample block are disclosed.

In one aspect, a thermal block assembly including a sample block and two or more thermoelectric devices, is disclosed. The sample block has a top surface configured to receive a plurality of reaction vessels and an opposing bottom surface. The thermoelectric devices are operably coupled to the sample block, wherein each thermoelectric device includes a housing for a thermal sensor and a thermal control interface with a controller. Each thermoelectric device is further configured to operate independently from each other to provide a substantially uniform temperature profile throughout the sample block.

In another aspect, a thermoelectric device including a first thermal conducting layer, a second thermal conducting layer, a plurality of Peltier elements and a thermal sensor, is disclosed. The Peltier elements are comprised of a semiconductor material and are sandwiched in between the first and the second thermal conducting layers. The thermal sensor is housed in between the first and the second thermal conducting layers.

In another aspect, a thermoelectric device including a first thermal conducting layer, a second thermal conducting layer, a plurality of Peltier elements and an open channel, is disclosed. The first and second thermal conducting layers have inner and outer surfaces. The plurality of Peltier elements comprised of semiconductor material that are adjacent to the inner surface of the first and second thermal conducting layers. The open channel is carved out of the first thermal conducting layer and the plurality of Peltier elements exposing the inner surface of the second thermal conducting layer. The open channel is configured to contain a thermal sensor.

In another aspect, a method for controlling sample block temperature is disclosed. A block assembly with a sample block and two or more thermoelectric devices (each housing a unique thermal sensor), is provided. The two or more thermoelectric devices are paired to their respective unique thermal sensors to form a thermal unit. The temperature of each thermal unit is independently controlled with a controller to provide a substantially uniform temperature profile throughout the sample block.

In another aspect, a thermal cycler system with a sample block assembly and controller, is disclosed. In various embodiments, the sample block assembly includes a sample block and two or more thermoelectric devices (each hosing a unique thermal sensor) in thermal communication with the sample block. In various embodiments, the sample block is configured to receive a plurality of reaction vessels. In various embodiments, the controller includes a computer processing unit with machine executable instructions and two or more communication ports. In various embodiments, each port is operably connected to one of the two or more thermoelectric devices and their respective thermal sensor. In various embodiments, the machine executable instructions are configured to individually adjust the temperature of each thermoelectric device based on the temperature measurements from their respective thermal sensor to provide a substantially uniform temperature profile throughout the sample block.

In another aspect, a thermal block assembly with two or more sample blocks, two or more sets of thermoelectric devices, a thermal control interface, and a controller, is disclosed. Each sample block has a top surface configured to receive a plurality of reaction vessels and an opposing bottom surface. Each set of thermo electric devices is operably coupled to each sample block. The thermal control interface is in communications with the controller.

In another aspect, a thermal block assembly with at least one sample block, at least one set of thermoelectric devices, a thermal control interface and a controller, is disclosed. The sample block has a top surface configured to receive a plurality of reaction vessels and an opposing bottom surface. The thermoelectric device is operable coupled to the sample block. The thermal control interface is in communications with the controller.

These and other features are provided herein.

BRIEF DESCRIPTION OF THE DRAWINGS

For a more complete understanding of the principles disclosed herein, and the advantages thereof, reference is now made to the following descriptions taken in conjunction with the accompanying drawings, in which.

Figure 1:
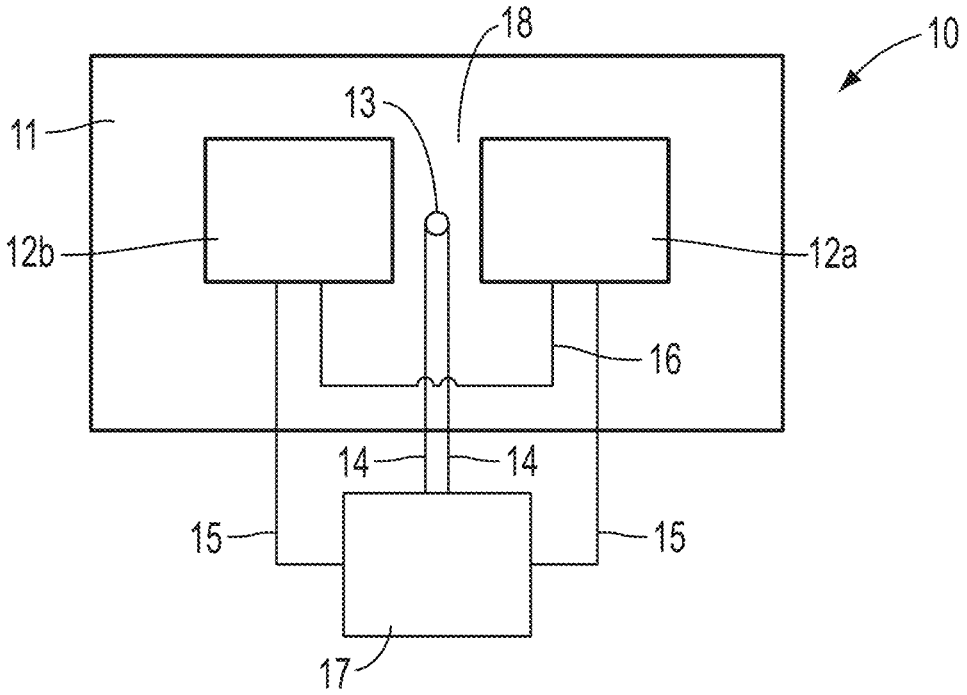
FIG. 1 is a block diagram that illustrates a sample block assembly according to the prior art.

It is to be understood that the figures presented herein are not necessarily drawn to scale, nor are the objects in the figures necessarily drawn to scale in relationship to one another. The figures are depictions that are intended to bring clarity and understanding to various embodiments of apparatuses, systems, and methods disclosed herein. Moreover, it should be appreciated that the drawings are not intended to limit the scope of the present teachings in any way.

DETAILED DESCRIPTION

Embodiments of apparatuses, systems and methods for providing thermal uniformity throughout a thermocycler sample block are described in this specification. The section headings used herein are for organizational purposes only and are not to be construed as limiting the described subject matter in any way.

Reference will be made in detail to the various aspects of the disclosure, examples of which are illustrated in the accompanying drawings. Wherever possible, the same reference numbers will be used throughout the drawings to refer to the same or like parts.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless defined otherwise, all technical and scientific terms used herein have the same meaning as is commonly understood by one of ordinary skill in the art to which the various embodiments described herein belongs. When definitions of terms in incorporated references appear to differ from the definitions provided in the present teachings, the definition provided in the present teachings shall control.

It will be appreciated that there is an implied "about" prior to the temperatures, concentrations, times, number of bases, coverage, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

Some of the embodiments described herein, can be practiced using various computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein can be useful as machine operations. The embodiments, described herein, can also relate to a device or an apparatus for performing these operations. The apparatuses, systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical, FLASH memory and non-optical data storage devices. The computer readable medium can also be distributed over a network coupled computer systems so that the computer readable code is stored and executed in a distributed fashion.

Generally, in the case of PCR, it can be desirable to change the sample temperature between the required temperatures in the cycle as quickly as possible for several reasons. First the chemical reaction has an optimum temperature for each of its stages and as such less time spent at non-optimum temperatures can mean a better chemical result is achieved. Secondly a minimum time is usually required at any given set point which sets minimum cycle time for each protocol and any time spent in transition between set points adds to this minimum time. Since the number of cycles is usually quite large, this transition time can significantly add to the total time needed to complete the amplification.

The absolute temperature that each reaction tube attains during each step of the protocol is critical to the yield of product. As the products are frequently subjected to quantization, the product yield from tube to tube must be as uniform as possible and therefore both the steady-state and dynamic thermal non-uniformity (TNU) must be excellent (i.e., minimized) throughout the block.

One skilled in the art will understand that many factors may contribute to a degraded TNU. Ambient effects, homogeneity of the sample block material, thermal interfaces between elements of a thermal block assembly, heated cover uniformity and efficiencies of the heating and cooling devices are some of the more common factors.

Additionally, TNU is dependent on the difference in temperature between the sample block and any elements or structures proximate to the sample block. In a typical construction of a sample block assembly, the sample block is physically mounted in an instrument and mechanically connected to elements of the instrument that may be at room temperature or ambient. The greater the difference in temperature is between the sample block and the ambient temperature elements of the instrument the greater the heat loss is from the block to the ambient elements. This heat loss is particularly evident at the edges and the corners of the sample block. Accordingly, TNU degrades as the temperature difference between the sample block and the ambient elements increase. For example, TNU is typically worse at 95° C. than it would be at 60° C.

One skilled in the art will also be familiar with common remedies used to improve a degraded TNU. Remedies such as heated cover geometries to enclose the sample block, electric edge heaters around the perimeter of the block and isolation of the sample block from ambient are all well known in the art.

Heat-pumping into and out of the samples can be accomplished by using various types of thermoelectric devices, including but not limited to, Peltier thermoelectric devices. In various embodiments, these Peltier devices can be constructed of pellets of n-type and p-type semiconductor material that are alternately placed in parallel to each other and are electrically connected in series. Examples of semiconductor materials that can be utilized to form the pellets in a Peltier device, include but are not limited to, bismuth telluride, lead telluride, bismuth selenium and silicon germanium. However, it should be appreciated that the pellets can be formed from any semiconductor material as long as the resulting Peltier device exhibits thermoelectric heating and cooling properties when a current is run through the Peltier device. In various embodiments, the interconnections between the pellets can be made with copper which can be bonded to a substrate. Examples of substrate materials that can be used include but are not limited to copper, aluminum, Aluminum Nitride, Beryllium Oxide, Polyimide or Aluminum Oxide. In various embodiments the substrate material can include Aluminum Oxide also known as Alumina. It should be understood, however, that the substrate can include any material that exhibits thermally conductive properties.

TNU of the sample block and therefore the samples can be critical to PCR performance. The concept of TNU is well known in the art as being a measured quantity usually obtained through the use of a TNU test fixture and thermal protocol (or procedure). Such a test fixture can include multiple temperature sensors that are individually inserted into a plurality of sample wells that are defined on the top surface of a sample block. In various embodiments, an array of 4 wells up to at least 384 wells can be defined on the top surface of a sample block. The actual wells selected for TNU measurements are frequently determined during the design of the sample block assembly and may represent those regions of the sample block that are most thermally diverse.

As discussed above, TNU can be measured through the use of a TNU protocol (or procedure). The protocol can be resident on a hand held device or a computer either of which is capable of executing machine-code. The protocol can dictate the ramp up and/or ramp down temperature or temperatures settings during which the TNU is to be measured. The thermal protocol may or may not include additional parameters depending on the type of TNU being measured. Dynamic TNU characterizes the thermal non-uniformity throughout the sample block while transitioning from one temperature to another. Static TNU characterizes the thermal non-uniformity of the sample block during a steady-state condition. The steady-state condition is usually defined as a hold time or dwell time. Further, the time lapsed during the hold time when the measurement is taken is also important due to the uniformity of the block improving with time.

For example, a TNU protocol can specify taking temperature measurements while cycling sample block temperatures between 95° C. and 60° C. The protocol can further specify the measurements being taken 30 seconds after the hold time or dwell time begins. At each temperature and time period all sensors in the fixture are read, and the results are stored in a memory.

The TNU is then calculated from the temperature readings obtained from the sensors. There are multiple methods of analyzing the temperature data. For example, one method for calculating TNU can involve identifying the warmest temperature and the coolest temperature recorded from all the sensors at a specific temperature point, for example 95° C. The TNU can then be calculated by subtracting the coolest temperature from the warmest temperature. This method can be referred to as the difference TNU.

Another example of calculating TNU can involve identifying the warmest temperature and the coolest temperature recorded from all the sensors at a specific temperature point, for example 95° C. The TNU can then be calculated by subtracting the coolest temperature from the warmest temperature, and then dividing the difference by two. This method can be referred to as the average difference TNU.

An industry standard, set in comparison with gel data, can express a TNU so defined as a difference of about 1.0° C., or an average difference of 0.5° C. Gel data refers to an analysis technique used in evaluating the results of DNA amplification through the use of electrophoresis in an agarose gel. This technique is well known to one skilled in the art of microbiology.

One of the most significant factors affecting the uniformity is variations in thermoelectric device performance between devices. The most difficult point at which to achieve good uniformity is during a constant temperature cycle that is set far away from ambient temperature. In practice, this would be setting a thermocycler at a constant temperature at approximately 95° C. or greater. Two or more thermoelectric devices can be matched under these conditions to make a set of devices, wherein they individually produce substantially the same temperature for a given input current. The thermoelectric devices can be matched to within 0.2° C. in any given set.

Many applications for heating and cooling a sample block utilize multiple Peltier devices. This is most common when the number of samples is large, for example 96 samples, 384 samples or greater than 384 samples. In these situations Peltier devices are typically connected thermally in parallel and electrically in series to provide each device with the same amount of electrical current, with the expectation that each device will produce substantially the same temperature across the block.

The electrical current can be provided by an electronic circuit frequently referred to, for example, as a controller, amplifier, power amplifier or adjustable power supply. Such a controller may also utilize a thermal sensor to indicate the temperature of a region of a sample block to provide thermal feedback. Thermal sensor devices such as thermistors, platinum resistance devices (PRT), resistance temperature detectors (RTD), thermocouples, bimetallic devices, liquid expansion devices, molecular change-of-state, silicon diodes, infrared radiators and silicon band gap temperature sensors are some of the well known devices capable of indicating the temperature of an object. In some embodiments the thermal sensor can be proximate to a Peltier device and in thermal communication with the sample block region. In representative systems of conventional art utilizing multiple Peltier devices, the number of Peltier devices used is typically an even number. For example, thermocycler systems with two, four, six or eight Peltier devices are well known in the art. In multiple device implementations the Peltiers can be grouped. For example, four devices can be a group of four devices or two groups of two devices. Six devices can be one group of six devices, two groups of 3 devices or 3 groups of two devices. Likewise eight devices can be one group of eight devices, two groups of four devices or four groups of two devices. The grouping is frequently dependent upon the application. For example, gradient enabled thermocycler systems typically utilize multiple groupings of two devices. In all conventional implementations of thermocylers with multiple Peltier devices, the individual devices within any group are typically electrically connected in series and thus not individually controlled.

Figure 2:
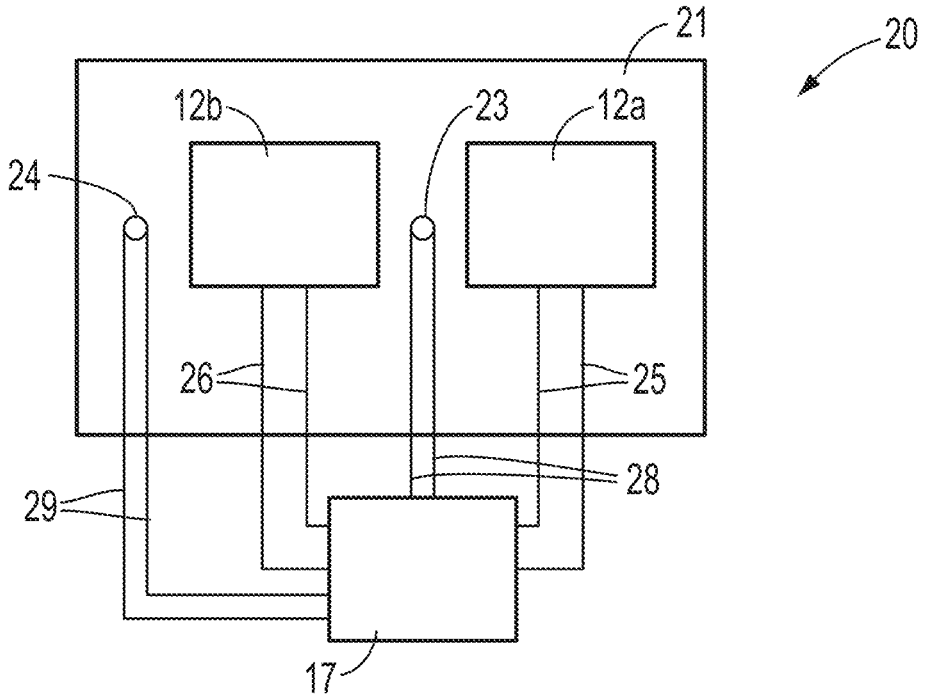
FIG. 2 is a block diagram that illustrates a sample block assembly providing independent control of two Peltier devices, in accordance with various embodiments.

FIG. 1 is a block diagram that illustrates a sample block assembly according to the prior art. As depicted herein, the sample block assembly 10 comprises a sample block 11, a pair of Peltier devices 12*a* and 12*b*, a thermal sensor 13 and a controller 17. The pair of Peltier devices 12*a* and 12*b* are electrically connected in series through electrical conduit 16 and electrically connected to the controller 17 through electrical conduits 15. The thermal sensor 13 is located in a gap 18 provided between the Peltier devices 12*a* and 12*b*, and is electrically connected to the controller 17 through electrical conduits 14. Gap 18 is necessary to provide continuous thermal communication between the sample block 11 and Peltier devices 12*a* and 12*b* and between thermal sensor 13 and sample block 11. It should be understood by one skilled in the art that what is depicted in FIG. 1 is not limited to two Peltier devices and may be scaled to apply to any number of Peltier devices. It should be noted that placing thermal sensor 13 in gap region 18 and electrically controlling Peltier devices 12*a* and 12*b* in series can be detrimental to achieving good thermal uniformity throughout the sample block. This is due in part to thermal cross interference from the two Peltier devices being simultaneously adjacent to thermal sensor 13 and because electrically controlling the Peltier devices in series does not allow for independent control of the current that is directed to each Peltier to allow for temperature compensation even if temperature non uniformities are detected on the sample block. FIG. 2 is a block diagram that illustrates a sample block assembly providing independent control of two Peltier devices, in accordance with various embodiments.

As depicted herein, thermal block assembly 20 can be comprised of sample block 21, Peltier devices 22*a* and 22*b*, a first sensor 23, a second sensor 24 and a controller 27. The configuration shown in FIG. 2 can provide for the independent control of Peltiers 22*a* and 22*b* to compensate for temperature non uniformities detected on sample block 21. This can be accomplished by electrically connecting Peltier 22*a* to controller 27 through electrical conduits 25 and Peltier device 22*b* to controller 27 through electrical conduits 26. Independent control of Peltier devices 22*a* and 22*b* to compensate for temperature non uniformities on sample block 21 can be further enabled through placing the first sensor 23 and the second sensor 24 adjacent to Peltiers 12*a* and 12, respectively. First sensor 23 can be electrically connected to controller 27 through electrical conduits 28 and the second sensor 24 can be electrically connected to controller 27 through electrical conduits 29. In this manner the temperature of Peltier device 22*a* can be dependent on the temperature indicated by first sensor 23, and the temperature of Peltier device 22*b* can be dependent on the temperature indicated by second sensor 24.

It should be understood, however, that although the independent control of the Peltier devices is a desired feature, the depicted arrangement of the elements in FIG. 2 is not ideal. This is due to thermal cross interference with the readings measured by sensor 23 as a result of the sensor 23 being placed in between Peltier devices 22*a* and 22*b*. That is, in the configuration depicted in FIG. 2, the temperature readings measured by sensor 23 are interfered with by the combination of temperatures of Peltiers 22*a* and 22*b*, which is detrimental to achieving good thermal uniformity throughout sample block 21.

Figure 3A:
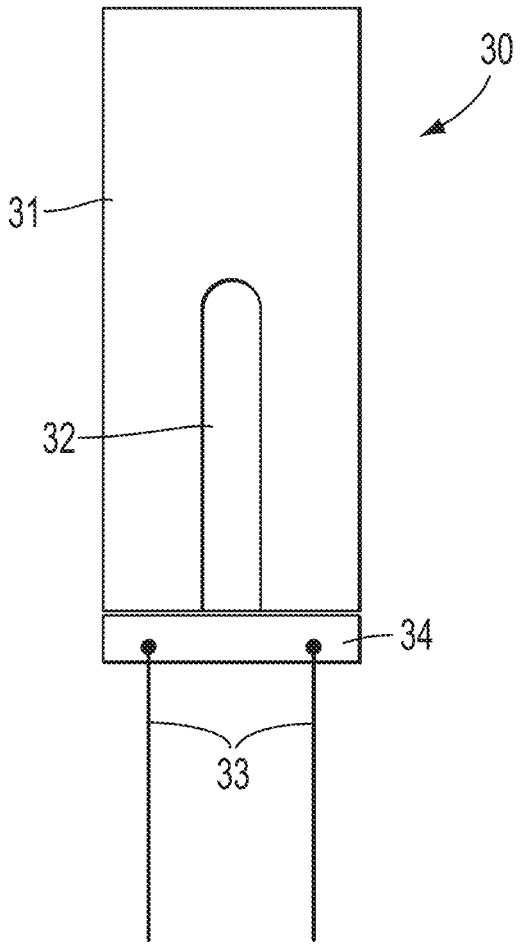
FIG. 3A is a top view of a Peltier device, in accordance with various embodiments.
Figure 3B:
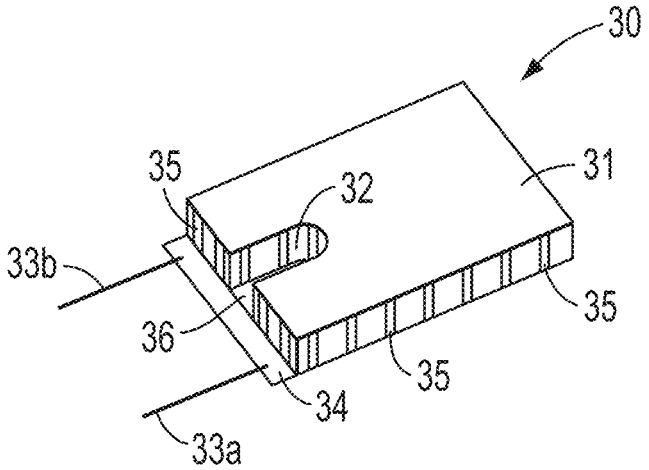
FIG. 3B is an isometric view of the Peltier device of FIG. 3A, in accordance with various embodiments.
Figure 3C:
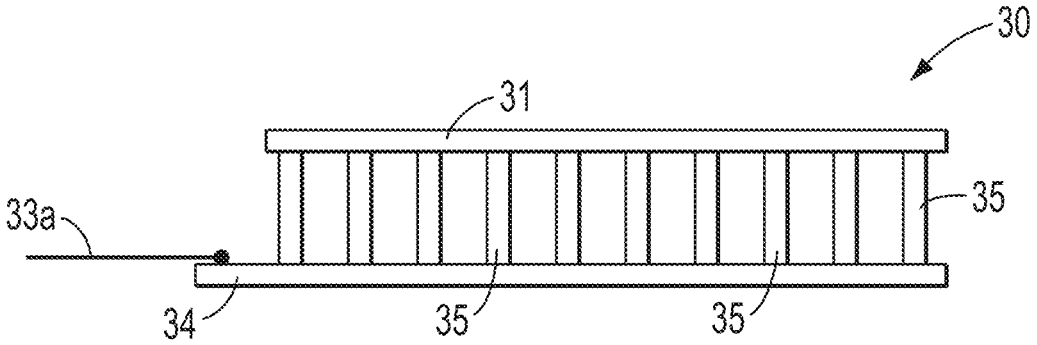
FIG. 3C is a cross sectional view of the Peltier device of FIG. 3A, in accordance with various embodiments.

FIGS. 3A, 3B and 3C depict various views of a Peltier device, in accordance with various embodiments. FIG. 3A is a top view of Peltier device 30, FIG. 3B is an isometric view of Peltier device 30 and FIG. 3C is a side view of Peltier device 30. One skilled in the art will recognize that the general layout and construction of the Peltier device shown in FIGS. 3A, 3B and 3C can be similar to conventional Peltier devices, but with some critical differences (as described below). For example, in various embodiments, Peltier device 30 can be comprised of a first thermal conducting layer 31, a second thermal conducting layer 34, and a plurality of semiconductor pellets 35 also referred to in the art as Peltier elements sandwiched in between the first 31 and the second 34 conducing layers. In various embodiments, the second thermal conducting layer 34 can be slightly longer in one dimension than first thermal conducting layer 31 to allow for the connection of wires 33 to provide electrical conduits for connection to controller 17. In various embodiments, an open channel 32 can be carved out of the first thermal conducting layer 31 and Peltier elements 35 to expose an inner surface 36 of second thermal conducting layer 34. In various embodiments open channel 32 can be a groove carved out of an edge surface of the Peltier device. In various embodiments open channel 32 can be carved out of the second thermal conducting layer 34 and Peltier elements 35, to expose an inner surface (not depicted) of the first thermal conducting layer 31. In various embodiments, open channel 32 can further be configured to contain or house a thermal sensor element that can be used to measure a temperature of a region of a sample block positioned adjacent to the thermal sensor. In various embodiments, the thermal sensor can be integrated into a housing within Peltier device 30. In various embodiments the open channel can be sized to accommodate the sensor chosen for a particular application.

One skilled in the art may recognize that carving out a portion of first thermal conducting layer 31 and Peltier elements 35 to form open channel 32 can adversely impact the TNU across a sample block. This can be caused by the absence of Peltier elements 35 in the region of open channel 32. This potential negative effect on TNU will be discussed later in this disclosure.

Figure 4:
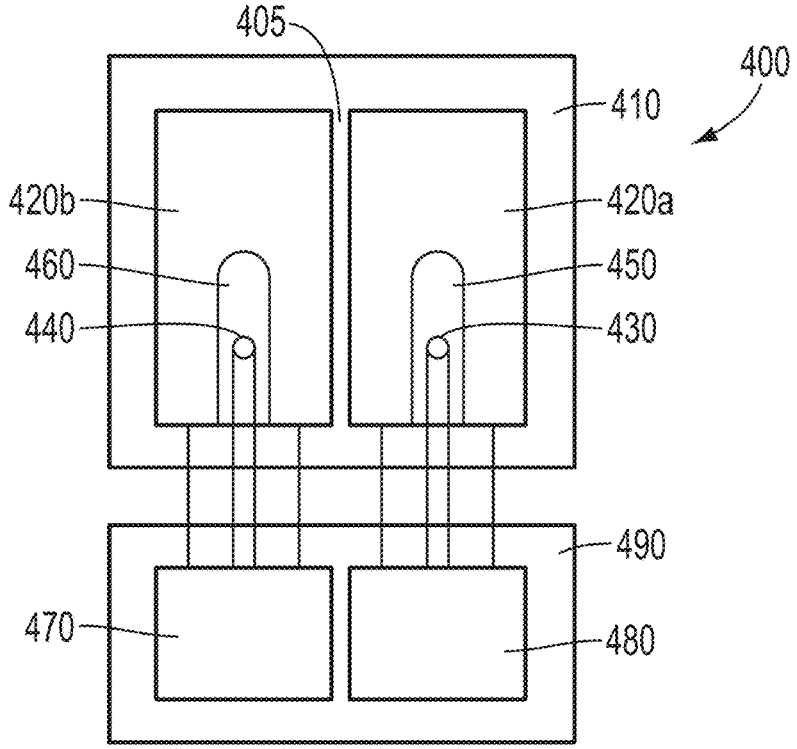
FIG. 4 is a block diagram that illustrates a multi-channel power amplifier system layout used to control the temperature of a sample block assembly, in accordance with various embodiments

FIG. 4 is a block diagram that illustrates a multi-channel power amplifier system layout used to control the temperature of a sample block assembly, in accordance with various embodiments. A multi-channel power amplifier system can be characterized by a controller circuit including multiple electrical circuits or channels. In various embodiments, each channel can be capable of providing electronic signals such as voltage and/or current to a unique thermoelectric device. That is, one channel can be assigned to one unique thermoelectric device. In various embodiments each channel is further capable of being interfaced to a thermal sensor located proximate to (or within) the unique thermoelectric device. The thermal sensor can be configured to convert temperature measurements to an electrical signal that can be read by the controller circuit. In various embodiments, each unique thermoelectric device is associated with a thermal sensor to form a thermoelectric device control unit that is in communications with a single channel. In various embodiments the controller circuit is in communication with an external processor and/or other external computing device capable of executing machine language instructions to provide operational instructions and/or control signals to the controller circuit. In various embodiments the processor can be embedded within the controller circuit or located external to the controller circuit but within a common housing with the controller circuit. In various embodiments the processor and/or computing device can be in communication with all the channels resident in the controller. In various embodiments the processor and/or other computing device can use each channel of the controller to independently control voltage and/or current provided to each unique thermoelectric device based on the electrical signals provided by the thermal sensor associated with the thermoelectric device. In various embodiments the control of voltage and/or current based on the electrical signal from the sensor represents a closed loop control system. In various embodiments the closed loop control system is capable of controlling the temperature of each thermoelectric device independently from each other thereby providing a substantially uniform temperature across the sample block.

As depicted herein, sample block assembly 400 can be comprised of sample block 410 and Peltier devices 420*a* and 420*b*. Peltier devices 420*a* and 420*b* can have substantially the same construction and features as those depicted in FIGS. 3A and 3B. Referring back to FIG. 4, in various embodiments, thermal sensor 430 can be housed or contained in open channel 450 of Peltier device 420*a*. Similarly, thermal sensor 440 can be housed or contained in open channel 460 of Peltier device 420*b*. In various embodiments, controller 490 may have one computer processor or many computer processors. In various embodiments, the computer processor or processors can be configured to execute machine-code suitable for thermal control of Peltier devices 420*a* and 420*b*. Controller 490 can further be configured to comprise two independently functional channels 470 and 480. Each channel can be connected to a single processor or each channel can have a dedicated processor. Channel 480 can be electrically connected to Peltier device 420*a* and associated with thermal sensor 430. Similarly, Channel 470 can be electrically connected to Peltier device 420*b* and associated with thermal sensor 440. The independent channel capability of controller 490 and the housing of thermal sensors 430 and 440 within open channels 450 and 460, respectively, can enable independent temperature control of Peltier devices 420*a* and 420*b*. The independence of the control channels can provide the capability to adjust the temperature of each Peltier device so as to ensure the regions of the sample block proximate to each Peltier device are maintained at the same temperature.

Referring to thermal sensor 13 of FIG. 1 and thermal sensors 23 and 24 of FIG. 2, one skilled in the art would recognize that locating the sensors next to the associated Peltier devices would require sufficient space between the Peltier devices to accommodate the sensors. The location of thermal sensor 430 in housing 450 (e.g., channel, groove or notch) of Peltier device 420*a* and thermal sensor 440 in housing 460 (e.g., channel, groove or notch) of Peltier device 420*b* as depicted in FIG. 4, enables the gap 405 between the Peltier devices to be reduced. The reduction of gap 405 can offer further opportunities to improve thermal uniformity throughout sample block 410.

Figure 5:
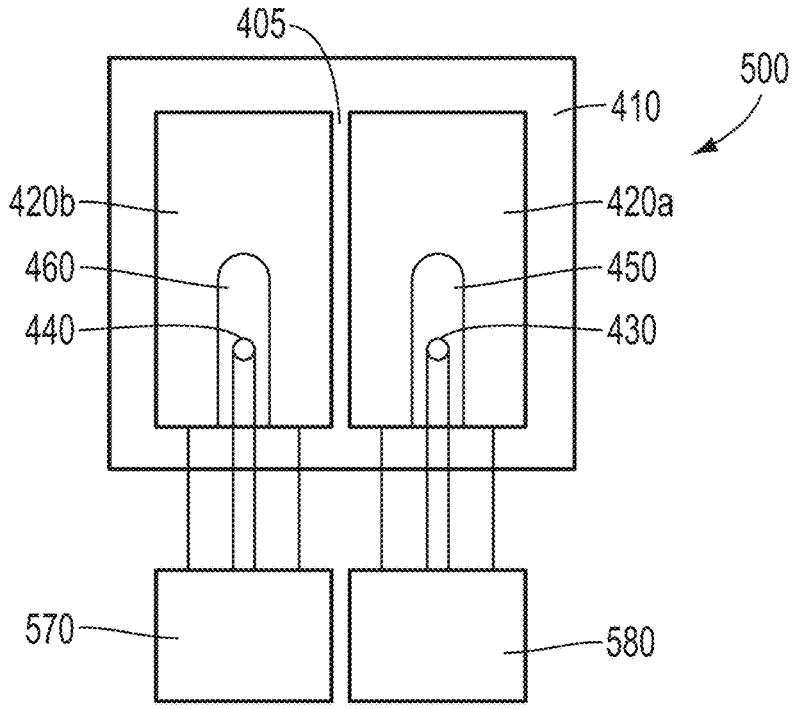
FIG. 5 is a block diagram that illustrates a multi-module power amplifier system layout used to control the temperature of a sample block assembly, in accordance with various embodiments.

FIG. 5 is a block diagram that illustrates a multi-module power amplifier system layout used to control the temperature of a sample block assembly, in accordance with various embodiments. A multi-module power amplifier can be differentiated from the multi-channel power amplifier depicted in FIG. 4. In various embodiments a multi-module power amplifier can be characterized as comprising multiple thermal control modules, wherein each module can be capable of providing electronic signals such as voltage and/or current to a thermoelectric device. In various embodiments each module is further capable of being interfaced to a thermal sensor located proximate to (or within) a unique to a thermoelectric device. The thermal sensor can be configured to convert temperature measurements to an electrical signal that can be read by the controller circuit. In various embodiments, each unique thermoelectric device is associated with a thermal sensor to form a thermoelectric device control unit that is in communications with a single thermal control module. In various embodiments each module is in communication with a unique processor and/or other computing device capable of executing machine language instructions. In various embodiments the unique processor can be embedded in each module or located external to each module. In various embodiments the processor can be in communication with a unique thermoelectric device and a unique thermal sensor associated with each module. In various embodiments the processor and/or other computing device associated with each module can independently control voltage and/or current to each thermoelectric device based on the electrical signals provided by the unique sensor associated with the thermoelectric device. In various embodiments the control of voltage and/or current based on the electrical signal from the sensor represents a closed loop control system capable of controlling the temperature of each thermoelectric device independently from each other thereby providing a substantially uniform temperature across the sample block.

As depicted herein, sample block assembly 500 can be comprised of a sample block 410 and Peltier devices 420*a* and 420*b*. FIG. 5 further shows thermal sensor 430 can be contained within an open channel 450 of Peltier device 420*a*. Similarly, thermal sensor 440 is shown contained within open channel 460 of Peltier device 420*b*. In various embodiments, sample block assembly 500 can be electrically connected to thermal control modules 570 and 580. Specifically, Peltier device 420*a* and associated thermal sensor 430 can be electrically connected to independent thermal controller 580, while Peltier device 420*b* and associated thermal sensor 440 can be electrically connected to independent thermal controller 570.

In various embodiments, independent thermal control modules 570 and 580 can be independent modules each comprising a computer processor capable of executing machine-code suitable for independent thermal control of a Peltier device and associated thermal sensor. Similar to the embodiments depicted in FIG. 4, the independence of the control modules can provide the capability to individually adjust the temperature of each Peltier device so as to ensure that all the regions of the sample block that is proximate to each Peltier device are maintained at the same temperature.

Figure 6:
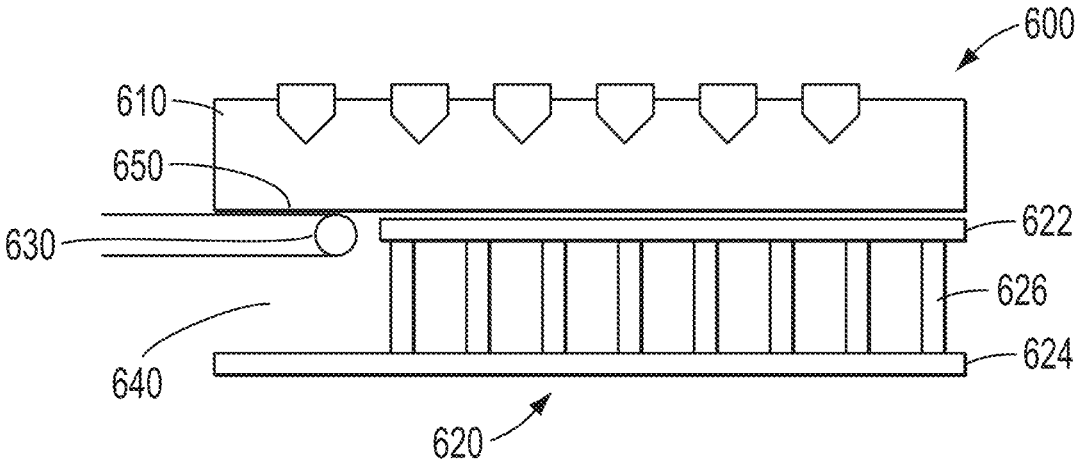
FIG. 6 is a cross sectional illustration of how a thermal sensor can be placed on a sample block assembly, in accordance with various embodiments.

FIG. 6 is a cross sectional illustration of how a thermal sensor can be placed on a sample block assembly, in accordance with various embodiments. As depicted herein, sample block assembly 600 comprises sample block 610, thermal sensor 630 and Peltier device 620. FIG. 6 further shows the elements of the Peltier device as being comprised of a first thermal conductive layer 622, a second thermal conductive layer 624, thermoelectric pellets 626 and an open channel 640. In various embodiments, the thermal sensor 630 can be housed in an open channel 640 and proximate to and in thermal communication with sample block region 650. In various embodiments, the thermal sensor 630 can be housed in a separate and distinct integrated housing (not shown) that is proximate to and in thermal communication with sample block region 650. In various embodiments, the thermal sensor 630 can be integrated (not shown) within Peltier device 620 and proximate to and in thermal communication with thermal conductive layer 622 that is in thermal communication with sample block region 650.

Figure 7:
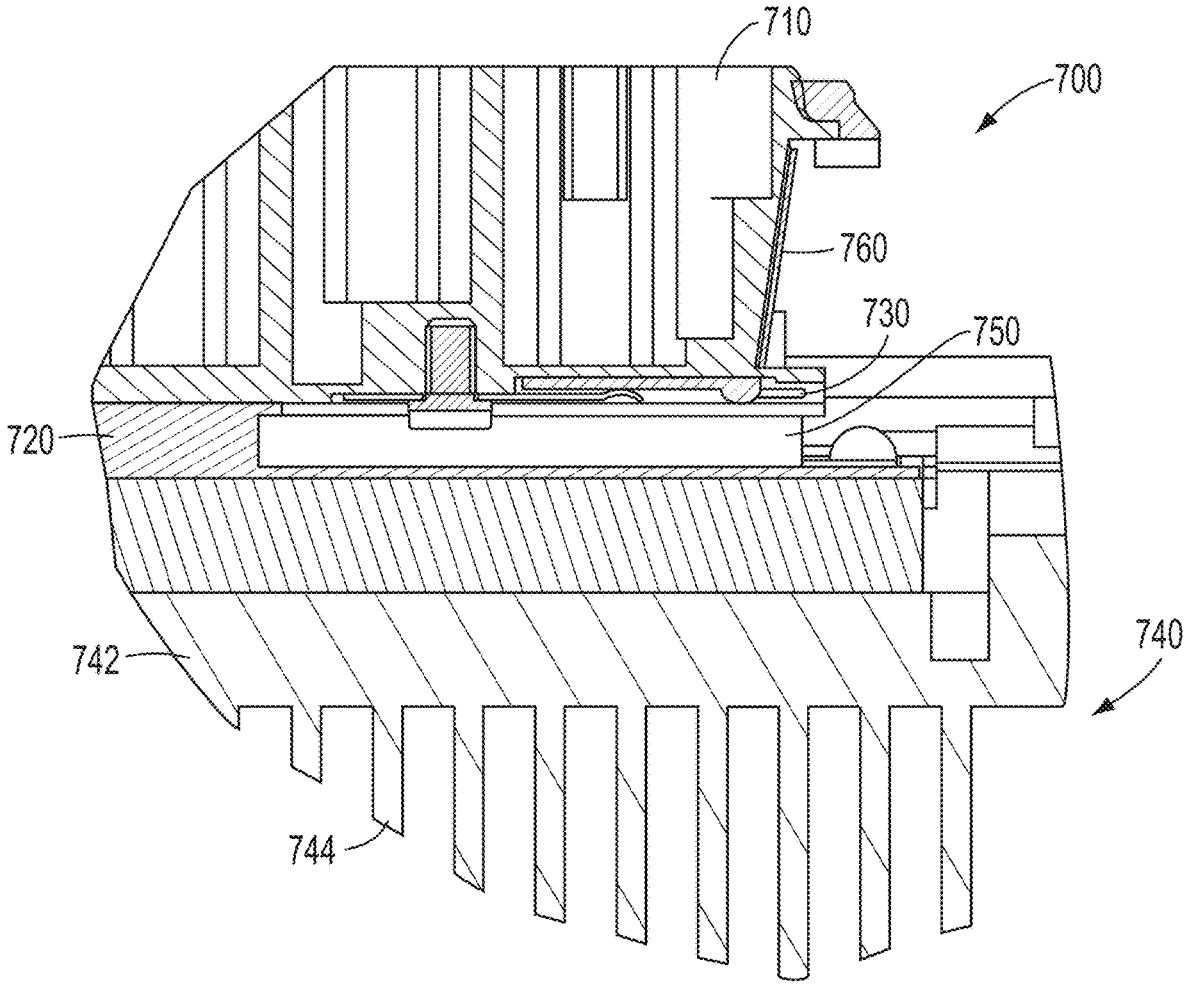
FIG. 7 is a cross sectional schematic of a sample block assembly, in accordance with various embodiments.

In various embodiments, the thermal block assembly depicted in block diagrams of FIGS. 4-6 can also include a heat sink that is in thermal contact with the thermoelectric devices. Such a thermal block assembly is shown in FIG. 7, which provides a cross sectional schematic of a sample block assembly, in accordance with various embodiments. As depicted herein, the thermal block assembly 700 comprised of sample block 710, Peltier device 720, open channel 750, thermal sensor 730 and heat sink 740. In various embodiments, heat sink 740 can further comprise a baseplate 742 and fins 744 extending from the bottom of the baseplate. Heat sink 740 can be in thermal contact with the Peltier device 720 and can contribute to the uniform removal (or dissipation) of heat from the sample block 710. Thermal block assembly 700 also shows a location for an edge heater 760. As discussed previously, in various embodiments, an edge heater 760 can be included in a thermal block assembly to counteract the heat flow from a sample block to areas of a lower temperature. Counteracting the heat flow from the sample block can provide an improvement to the TNU performance of the sample block assembly.

In some embodiments, the thermal block assembly can include more than one sample block. An example of such a sample block assembly is shown as FIG. 8 which provides a cross sectional illustration of a multi-block sample block assembly and how the various heat sink elements are integrated with the sample block assembly, in accordance with various embodiments.

As depicted herein, sample block assembly 800 can be comprised of sample block 810 and sample block 820. Sample block 810 can be in thermal contact with Peltier device 815 and sample block 820 can be in thermal contact with Peltier device 825. In the embodiment shown in FIG. 8 sample block 810 and 820 and their respective Peltier devices 815 and 825 are also in thermal contact with heat sink 830.

Figure 8:
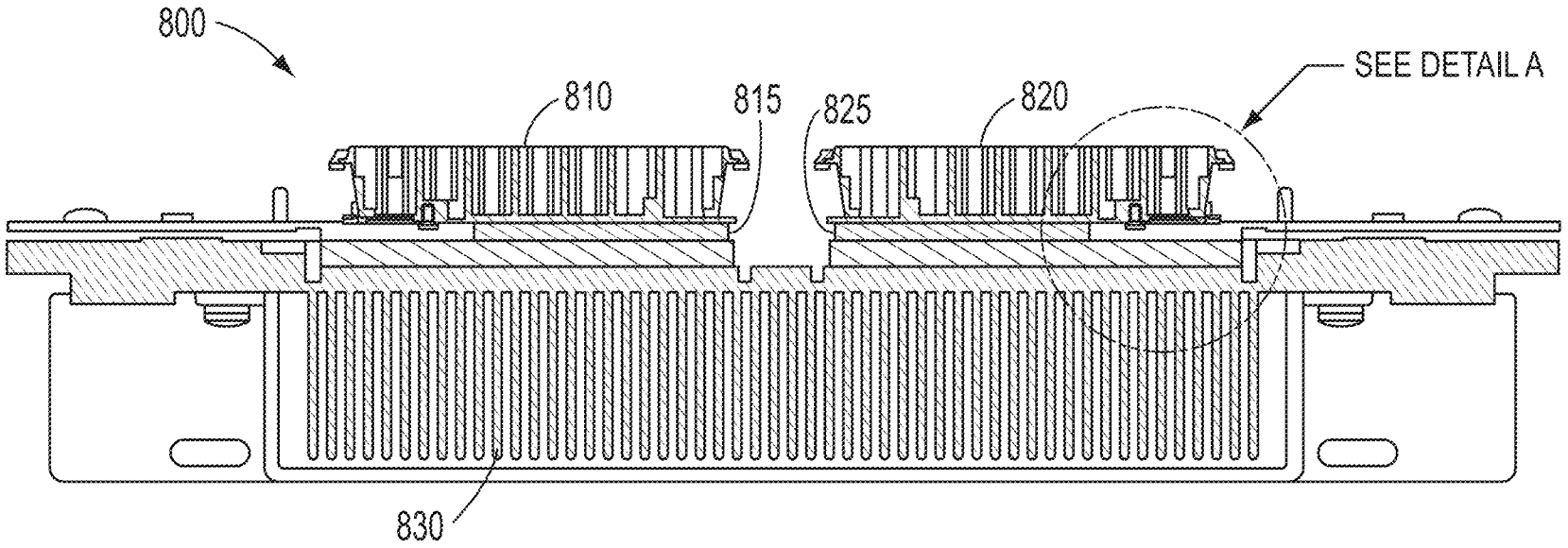
FIG. 8 is a cross sectional illustration of a multi-block sample block assembly and how the various heat sink elements are integrated with the sample block assembly, in accordance with various embodiments.

In various embodiments, the sample block assembly of FIG. 8 can also have more than one heat sink. In such a configuration, sample block 810 and 820 and their respective Peltier devices 815 and 825 of sample block assembly 800 can each be in thermal contact with their own individual heat sinks (not shown). That is, sample block assembly 800 can be comprised of two or more sample blocks. Each sample block can be associated with a set of Peltier devices and a heat sink. Such configuration can allow for independent thermal control of each of the sample blocks contained within sample block assembly 800.

Figure 9:
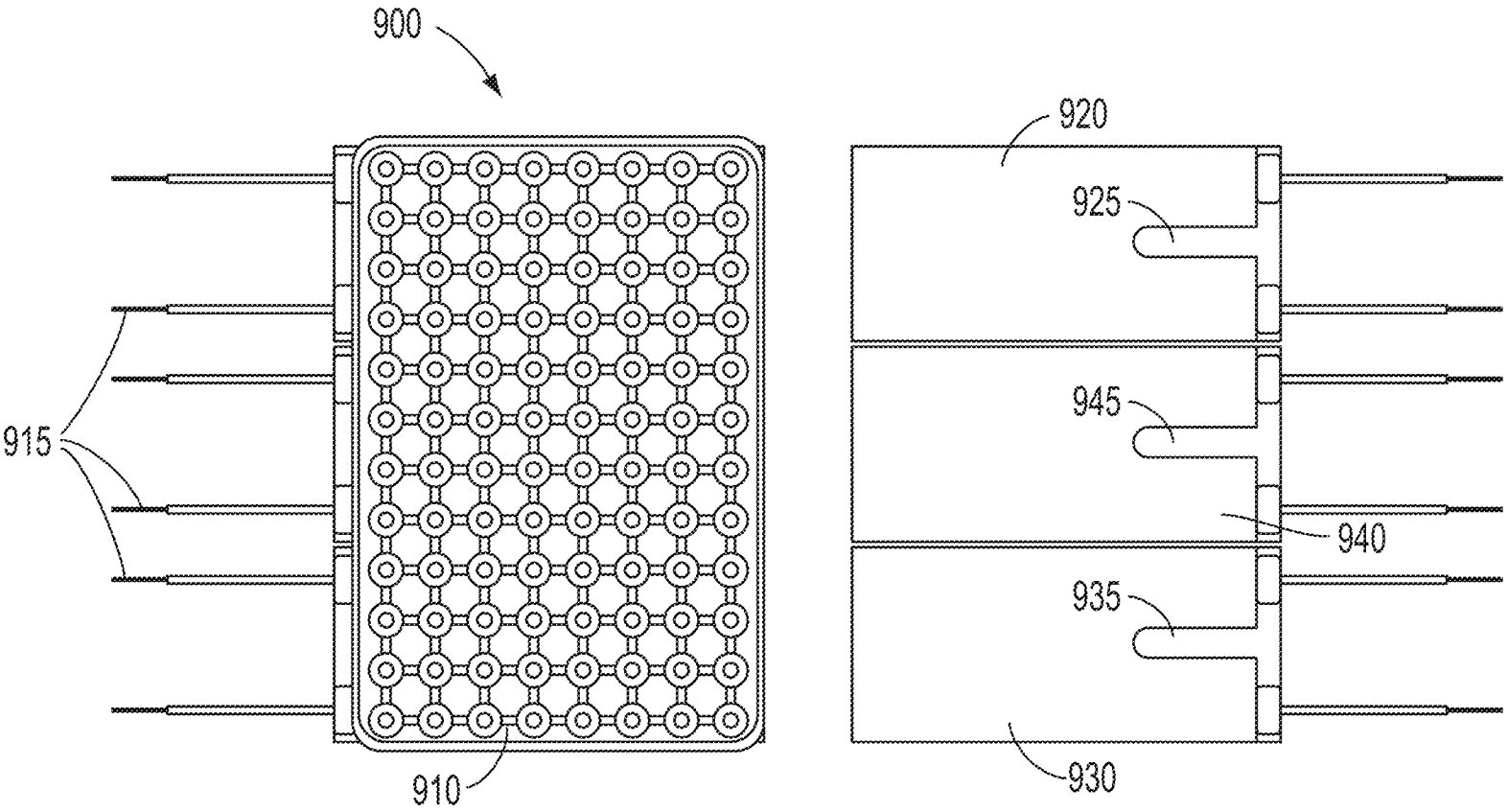
FIG. 9 is a top-view of a block diagram that illustrates how the individually controlled Peltier devices are positioned underneath a sample block, in accordance with various embodiments.

FIG. 9 is a top-view block diagram that illustrates how the individually controlled Peltier devices are positioned underneath a sample block, in accordance with various embodiments. As depicted herein, thermal block assembly 900 can be comprised of more than one sample block. That is, as depicted, sample block 910 is depicted as being located on top of three Peltier devices (920, 930, 940). While the three Peltier devices are not visible underneath sample block 910, the pairs of electrical connectors 915 that are shown to the left of the sample block 910 depicts the relationship between the sample block 910 and the associated Peltier devices (920, 930, 940). The right side of FIG. 9 shows three Peltier devices 920, 930 and 940. Peltiers 920, 930 and 940 are shown without an associated sample block and depicts what would be exposed if sample block 910 was removed. Further, Peltier devices 920, 930 and 940 are arranged such that open channels 925, 935 and 945 are located to the right. Similarly, though not shown, the Peltier devices located under sample block 910 have open channels similar to open channels 925, 935 and 945. In various embodiments a Peltier device can be located under the center region of the sample block, with additional Peltier devices around the outer perimeter of the center Peltier. Such an embodiment can contribute to improving the thermal uniformity of the sample block by providing independent thermal control to the center and each side of the sample block. The open channels in the Peltier devices under sample block 910, however, would be located to the left. In various embodiments the independent control of each of the Peltier devices can enable the correction of small temperature variations throughout the sample block. Small temperature variations can occur for various reasons including but not limited to mismatched or unmatched Peltier devices, imperfect thermal coupling between the sample block and the Peltier devices, imperfect thermal coupling between the Peltier devices and the heat sink, non-uniform thermal conductivity in the sample block, and non-uniform thermal diffusion of heat into the heat sink. In various embodiments the effects of the small variations can be minimized by independently enabling small electrical control adjustments to each Peltier device based on feedback from the thermal sensor (placed within or proximate to each Peltier device) thereby driving small thermal adjustments to provide a substantially uniform temperature throughout the sample block. In various embodiments the capability of driving small thermal adjustments to minimize small variations in temperature can also be effective in minimizing differences in thermal uniformity between instruments. It is important to note that representative systems of the conventional art typically configure multiple Peltier devices electrically in series. While the series configuration enables the multiple Peltier devices to be subjected to the same electrical current, the series configuration can be prohibitive to independent discrete control of single Peltier elements. Therefore the capability of representative systems of the conventional art can be limited and inhibits small electrical control adjustments to individual Peltier devices that result in small temperature adjustments to provide substantially uniform temperature throughout the sample block.

Figure 10:
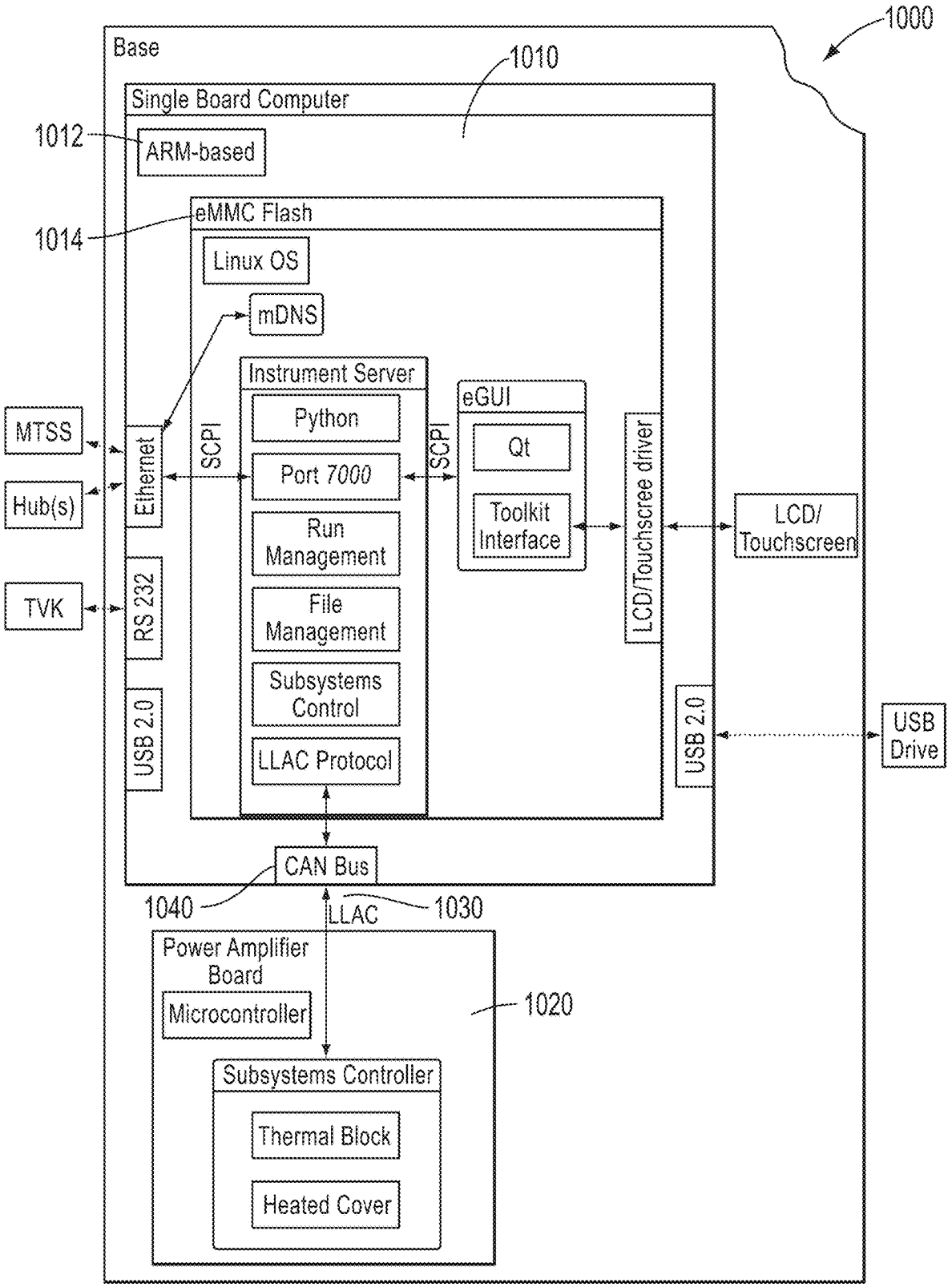
FIG. 10 is a logic diagram that illustrates the firmware control architecture for controlling the temperature of a sample block assembly, in accordance with various embodiments.

FIG. 10 is a logic diagram that illustrates the firmware control architecture for controlling the temperature of a sample block assembly, in accordance with various embodiments. As shown herein, thermocycler system 1000 depicts a thermal block assembly 1020 and a thermal control interface 1030 in communications with controller 1010 through communications port 1040. One skilled in the art will appreciate that although only one communication port 1040 is shown, any number of communication ports may be included to communicate through one or more thermal control interfaces 1030 to any number of sample block assemblies 1020. Controller 1010 is further shown to comprise computer processing unit 1012. The computer processing unit 1012 is capable of executing machine instructions contained in computer readable medium 1014. Computer processing unit 1012 can be any processor known in the art capable of executing the machine instructions contained in the computer readable medium 1014. Further, computer readable medium 1014 can be any type of storage medium known in the art suitable for the application. As presented previously, examples of such computer readable storage medium include hard drives, network attached storage (NAS), read-only memory, random-access memory, CD-ROMs, CD-Rs, CD-RWs, magnetic tapes, and other optical, FLASH memory and non-optical data storage devices. The computer readable storage medium can also be distributed over network coupled computer systems so that the computer readable code is stored and executed in a distributed fashion.

Figure 11:
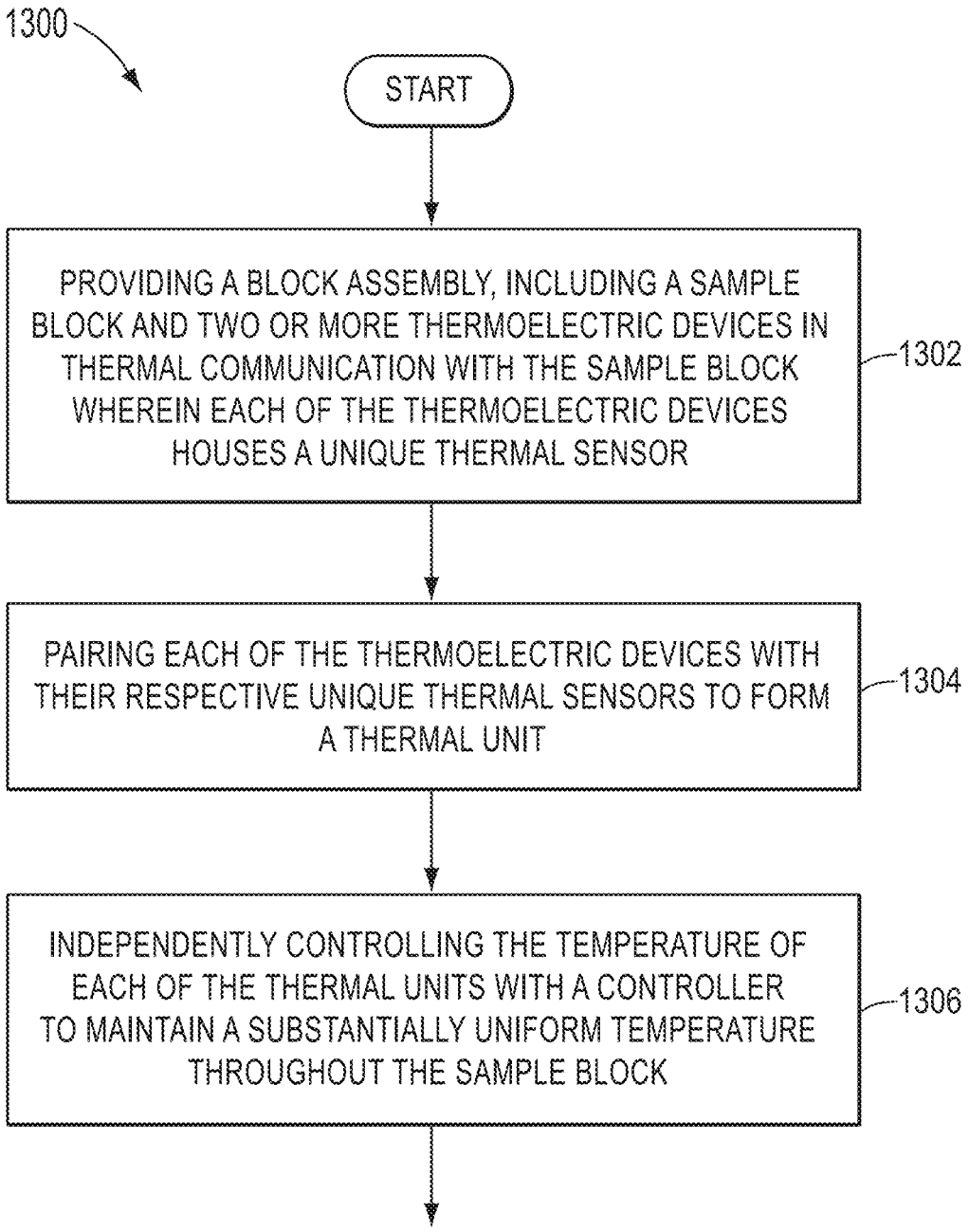
FIG. 11 is an exemplary process flowchart of how thermal uniformity can be achieved throughout a sample block, in accordance with various embodiments.
Figure 12A:
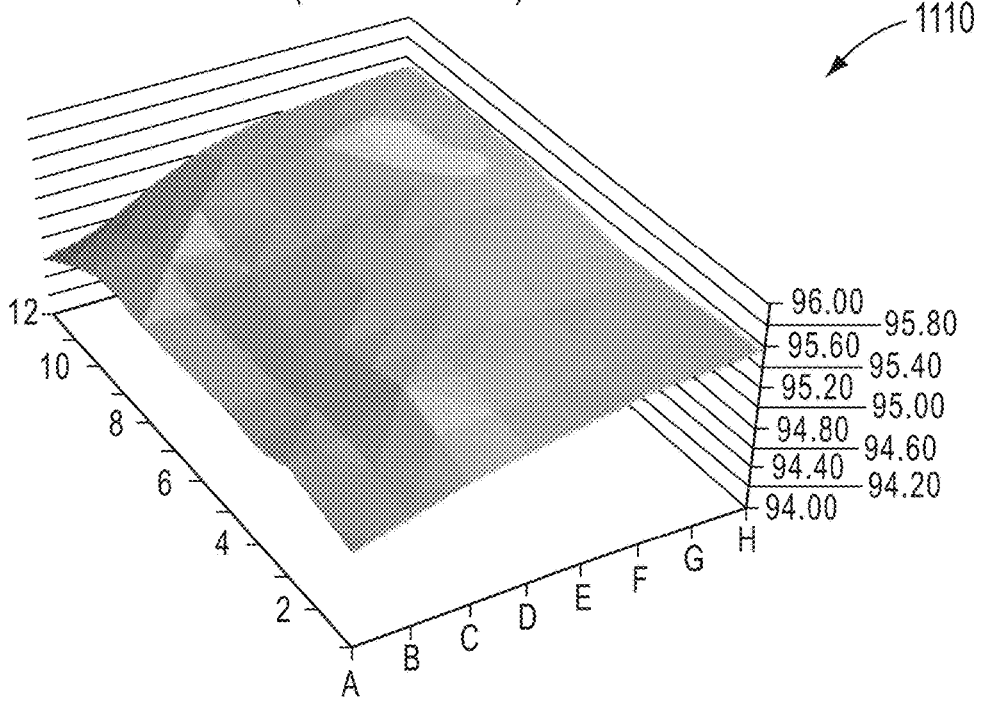
FIGS. 12A-12D are thermal plots depicting the thermal non-uniformity (TNU) performance profile of a dual 96-well sample block assembly without integrated edge heating elements, in accordance with various embodiments.
Figure 12B:
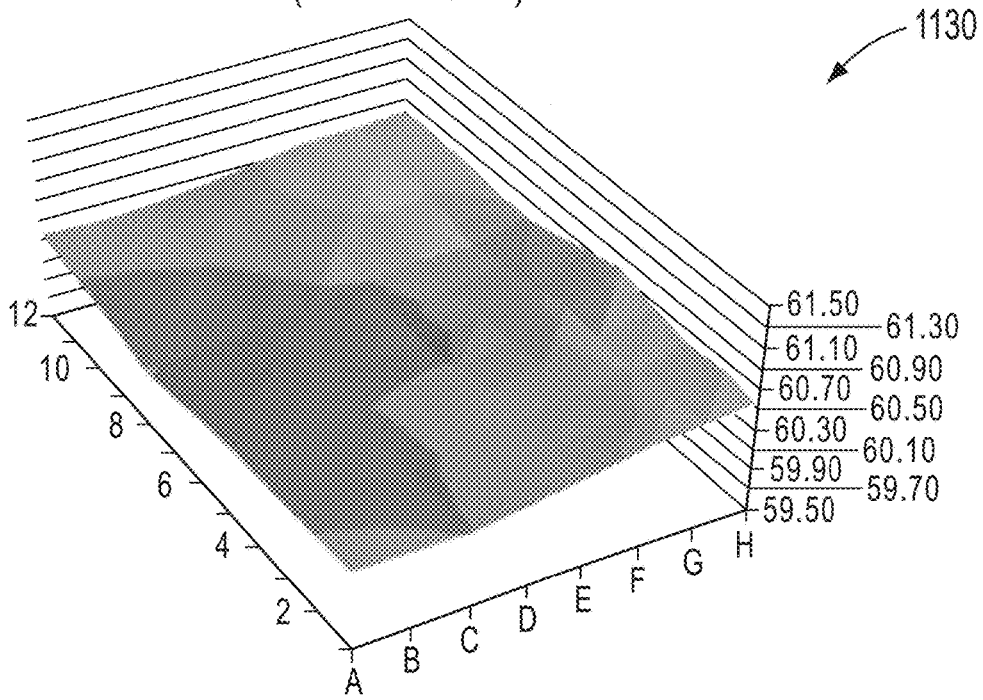
Figure 12C:
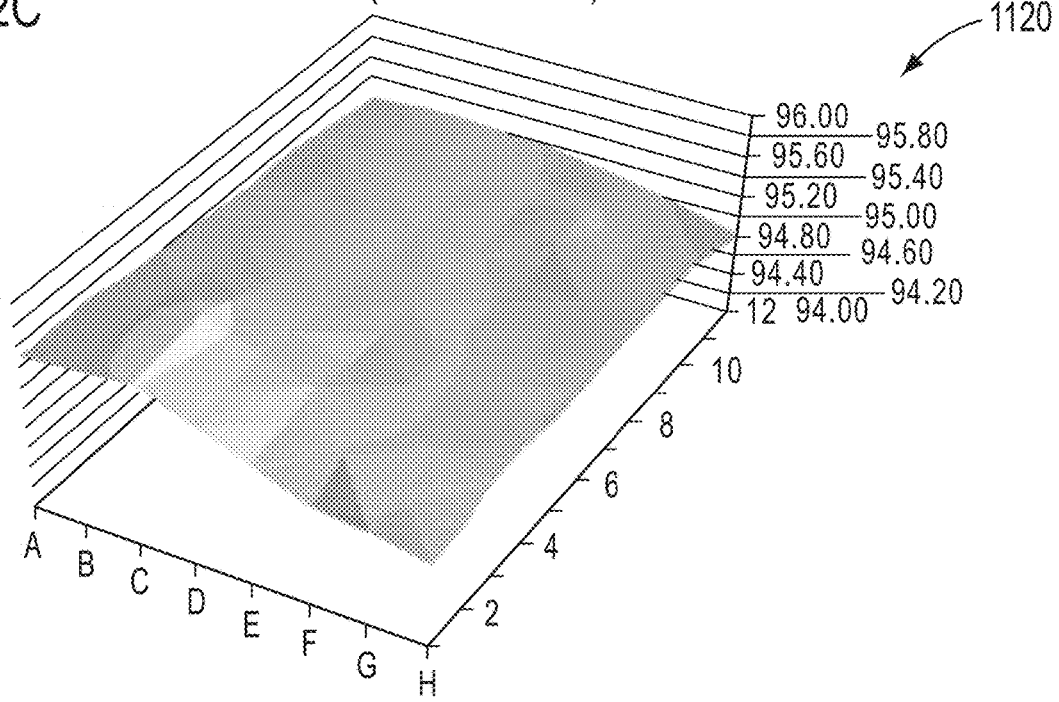
Figure 12D:
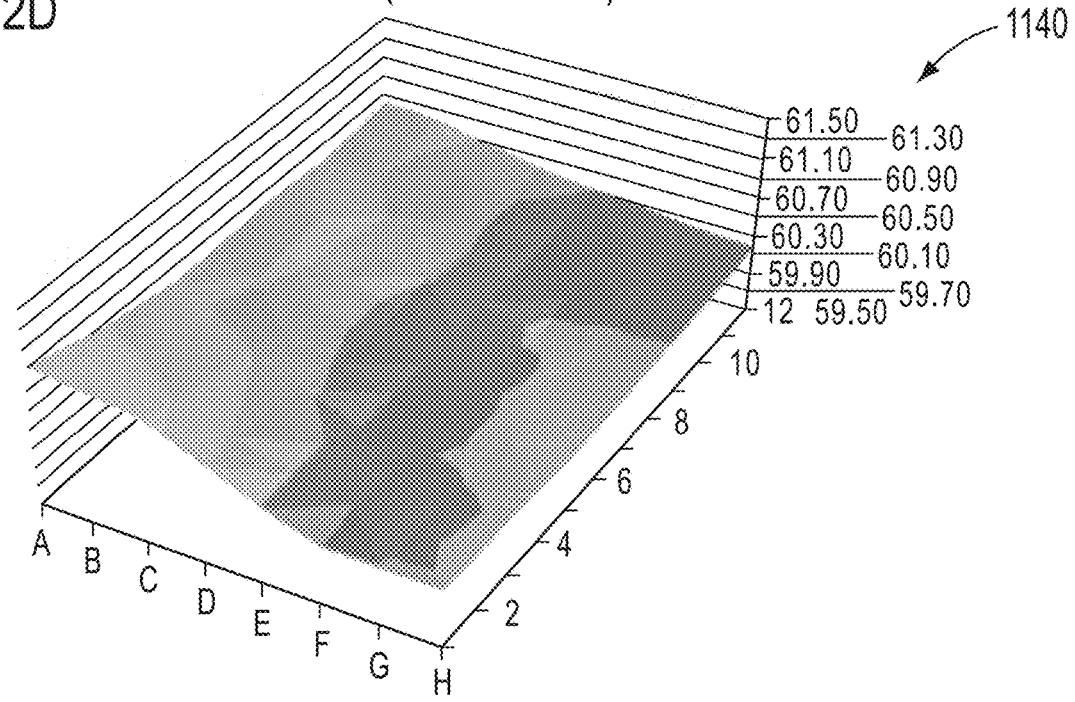
Figure 13A:
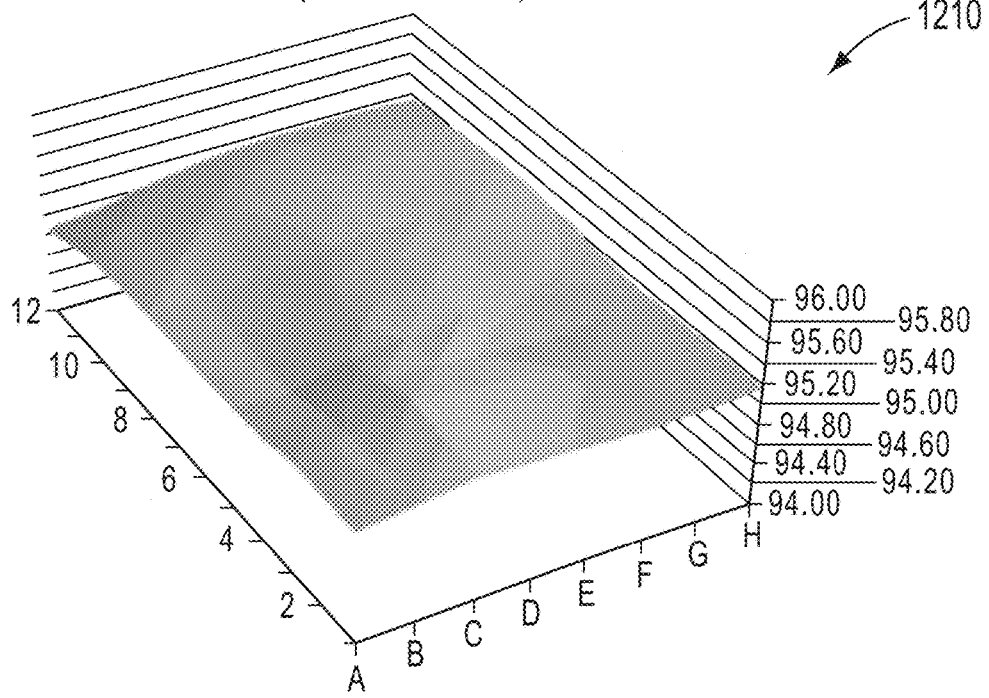
FIGS. 13A-13D are thermal plots depicting the thermal non-uniformity (TNU) performance profile of a dual 96-well sample block assembly with integrated edge heating elements, in accordance with various embodiments.
Figure 13B:
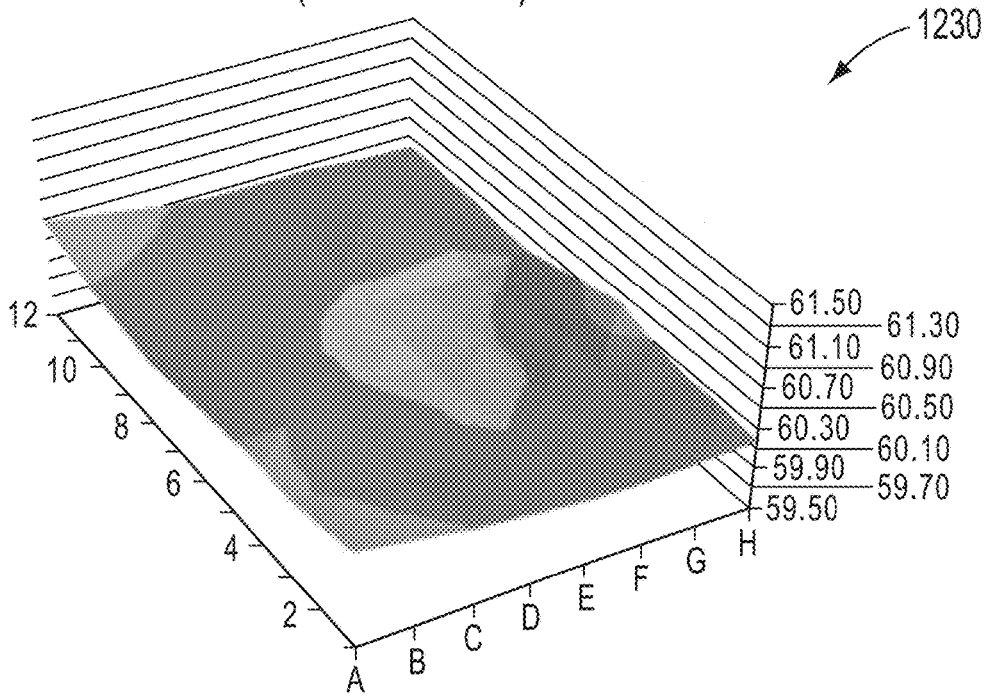
Figure 13C:
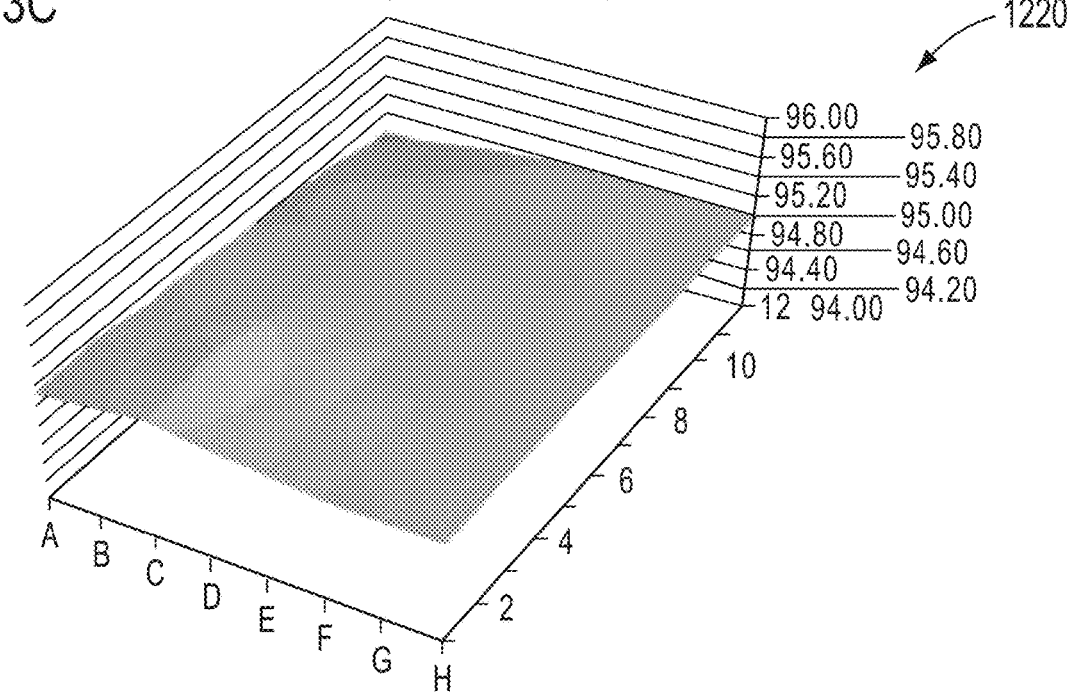
Figure 13D:
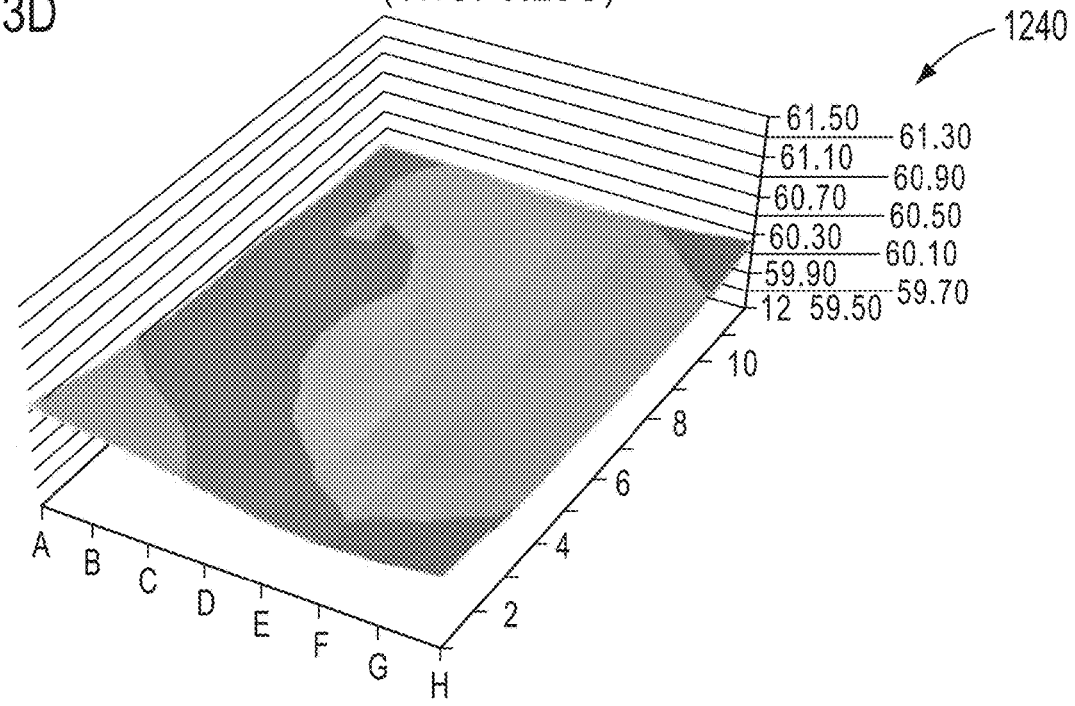
Figure 14A:
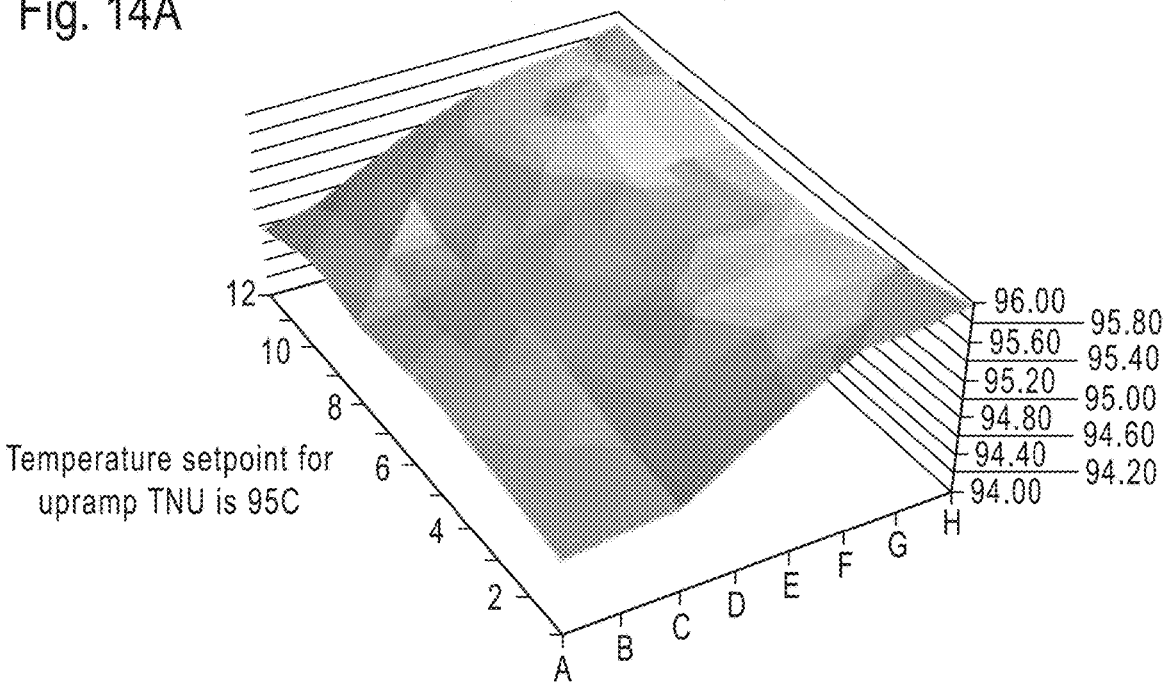
FIGS. 14A-14D are thermal plots depicting the thermal non-uniformity (TNU) performance profile of a dual flat-block sample block assembly without integrated edge heating elements, in accordance with various embodiments.
Figure 14B:
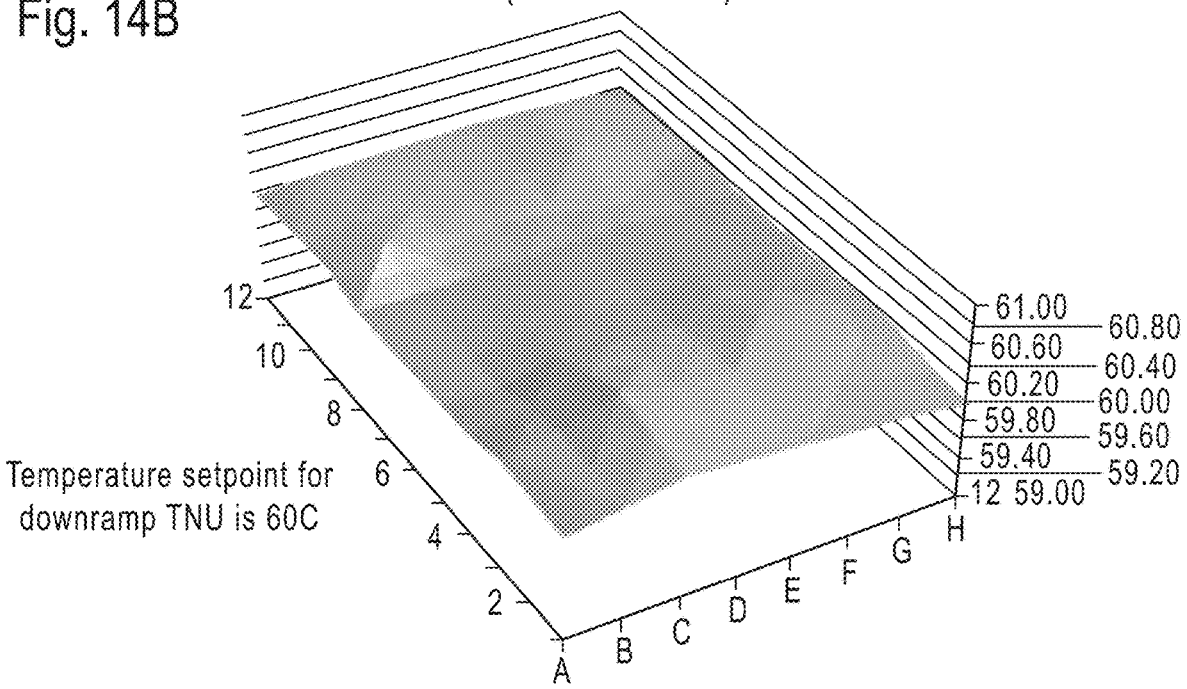
Figure 14C:
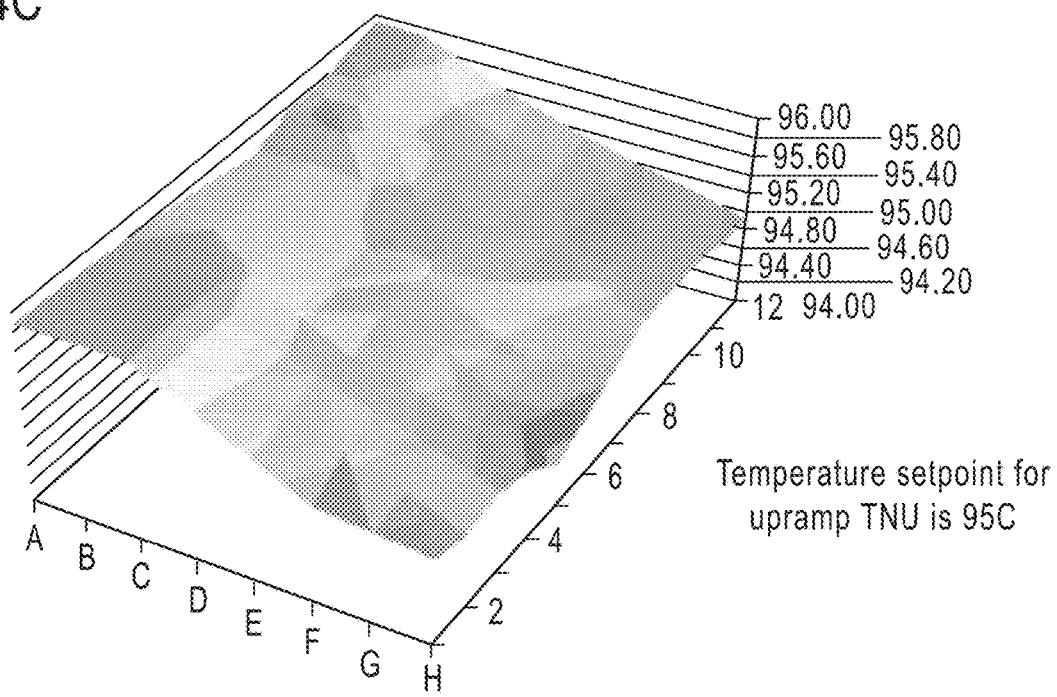
Figure 14D:
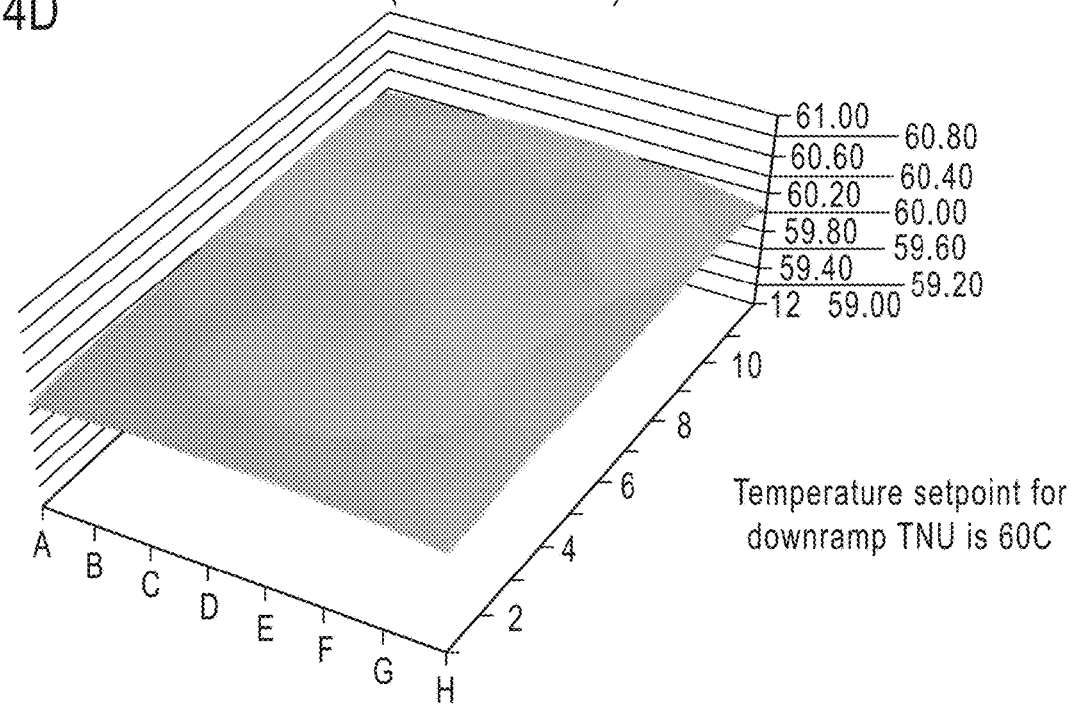
Figure 15A:
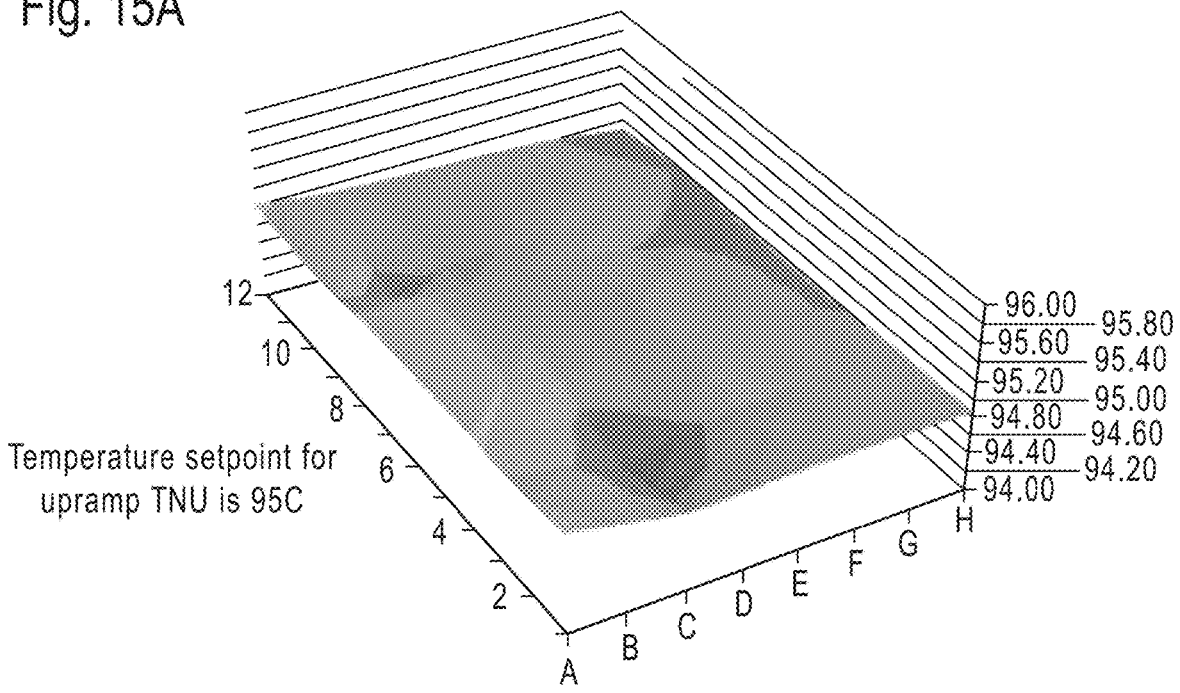
FIGS. 15A-15D are thermal plots depicting the thermal non-uniformity (TNU) performance profile of a dual flat-block sample block assembly with integrated edge heating elements, in accordance with various embodiments.
Figure 15B:
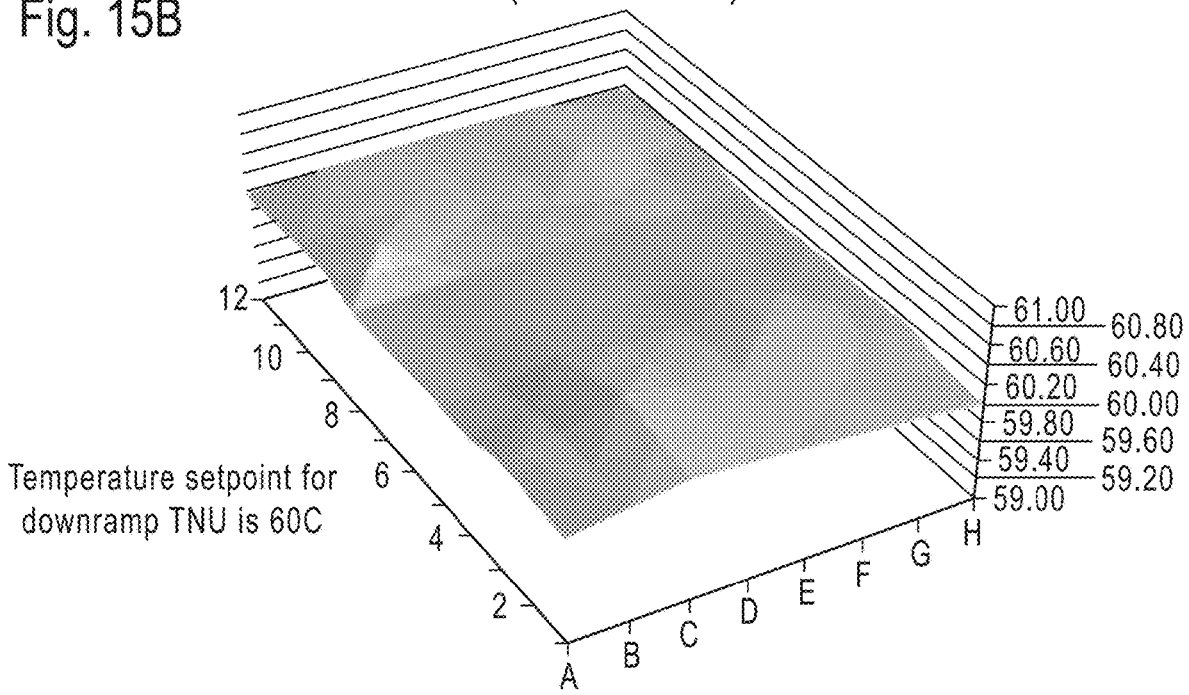
Figure 15C:
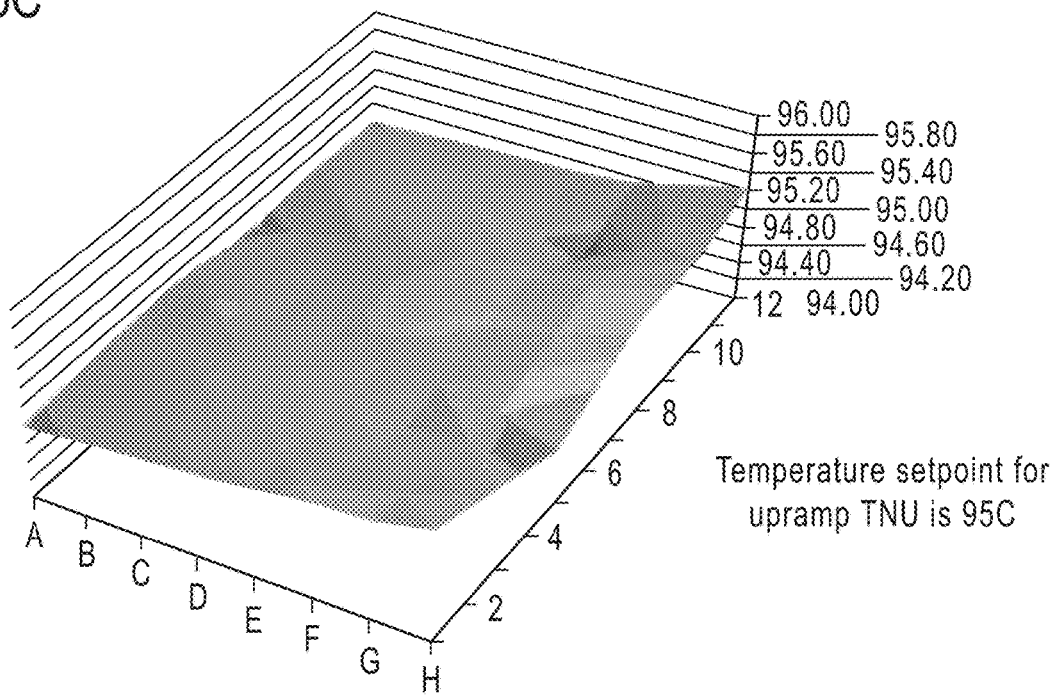
Figure 15D:
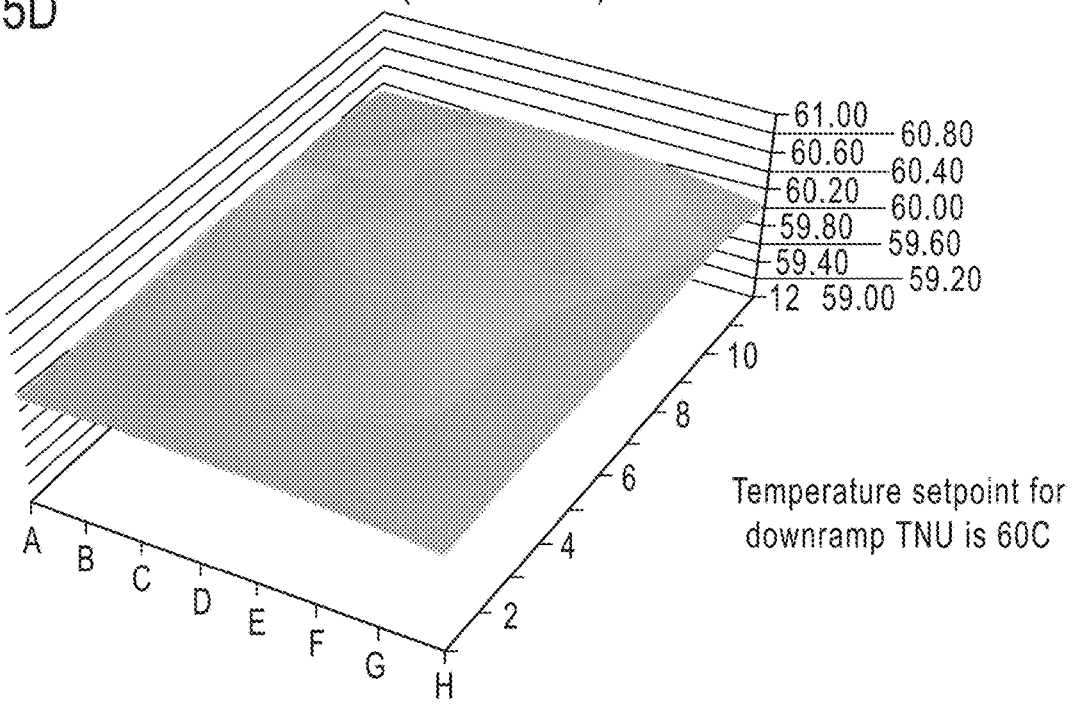
Figure 16A:
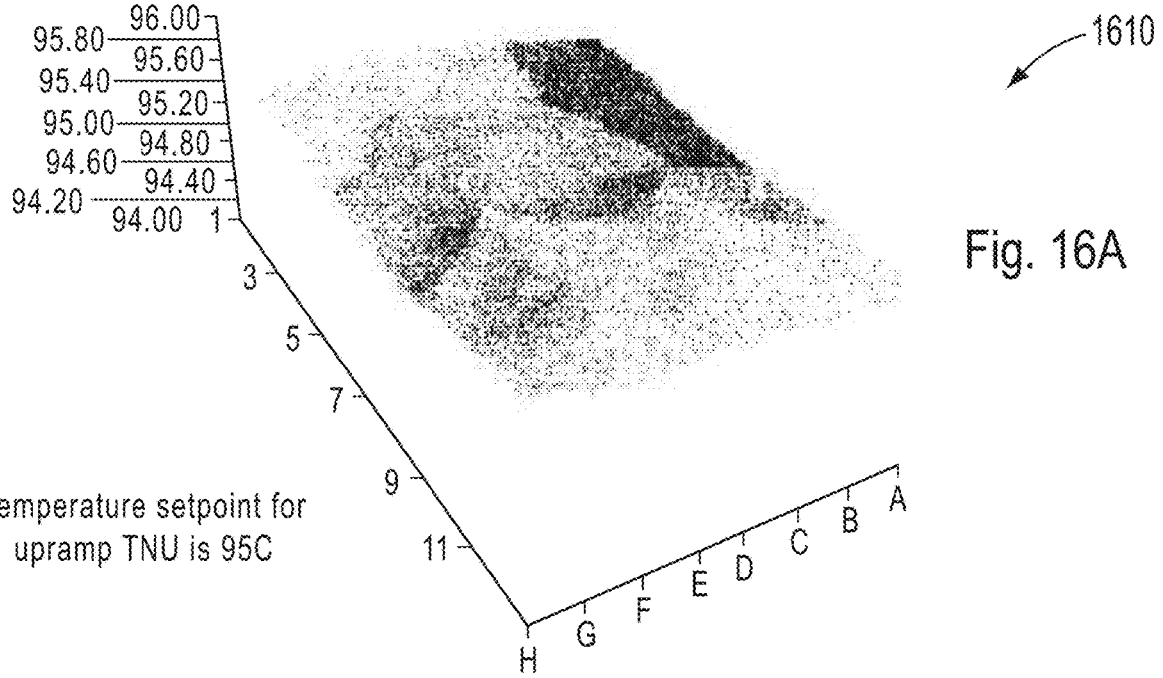
FIGS. 16A-16D are thermal plots depicting the thermal non-uniformity (TNU) performance profile of a dual flat-block sample block assembly with integrated edge heating elements, in accordance with conventional art.
Figure 16B:
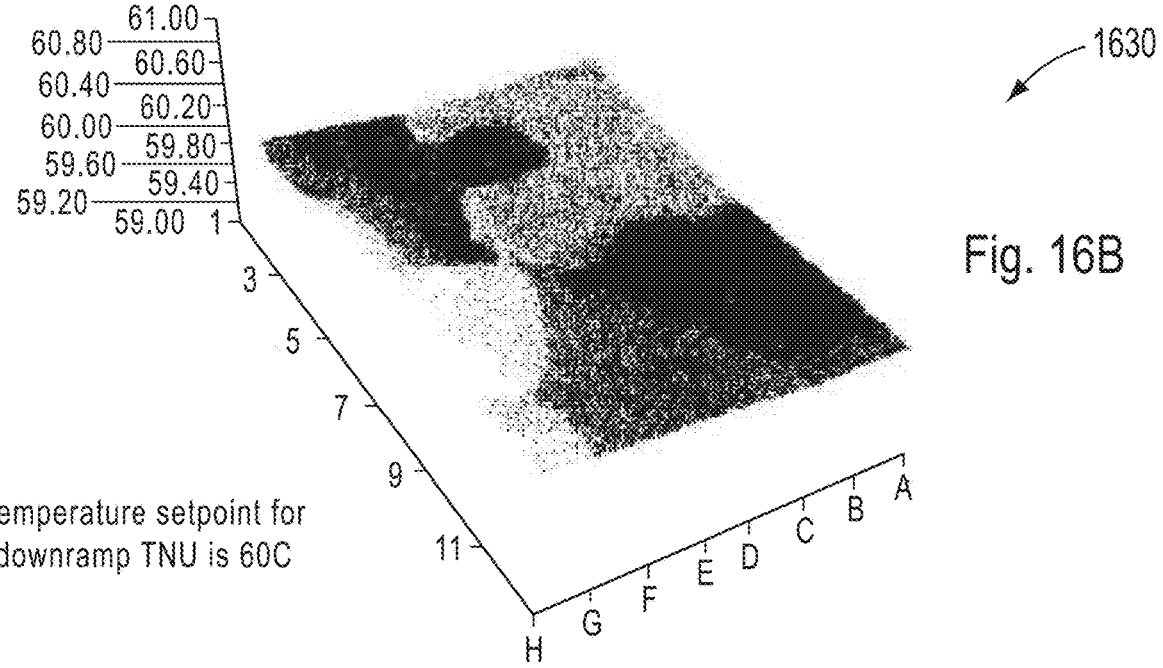
Figure 16C:
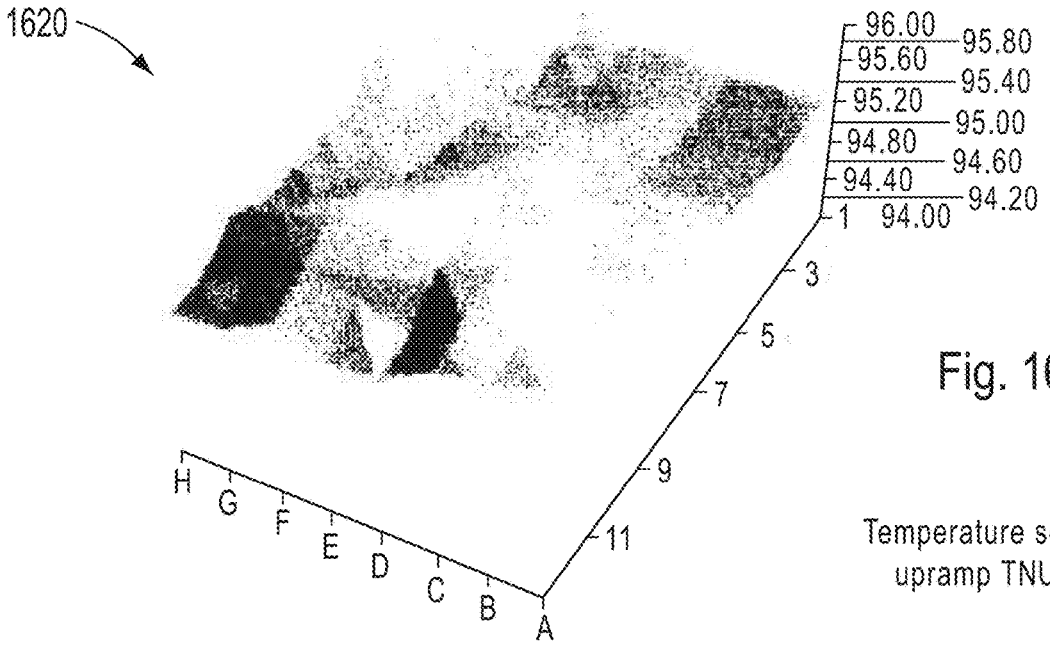
Figure 16D:
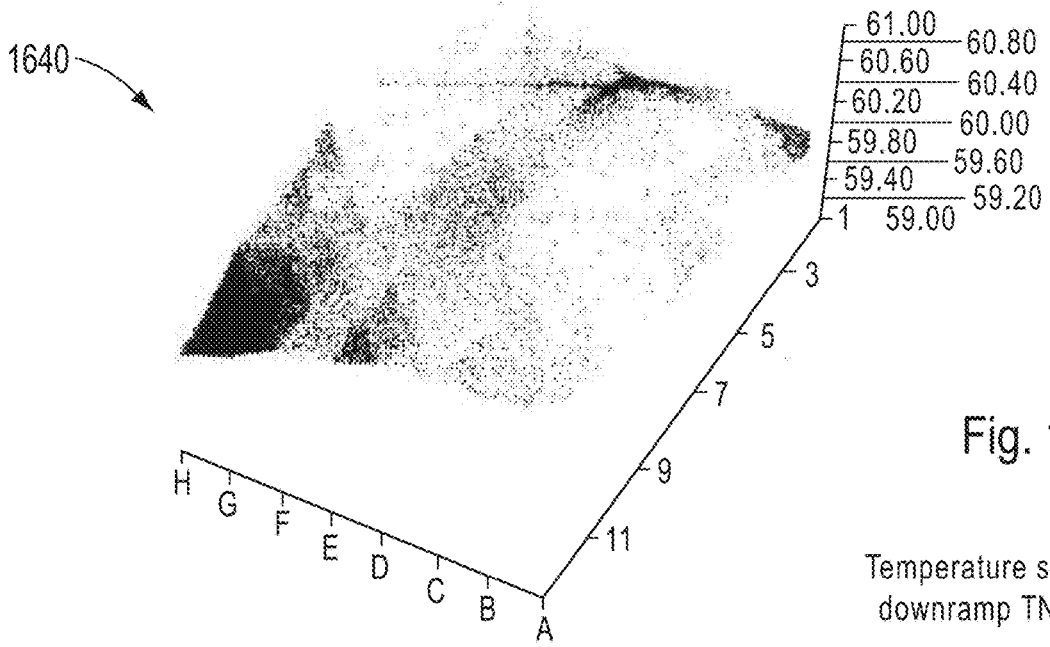

FIG. 11 is an exemplary process flowchart showing how thermal uniformity can be can be achieved throughout a sample block, in accordance with various embodiments. In step 1302, a block assembly is provided. In various embodiments, the block assembly can include a sample block and two or more thermoelectric devices in thermal communication with the sample block. In various embodiments, each of the thermoelectric devices can house a unique thermal sensor. In various embodiments, in step 1304, each of the thermoelectric devices can be paired along with their respective unique thermal sensor to form a unique, physical thermal unit.

According to various embodiments each unique physical thermal unit can be controlled independently as previously presented. The independent control capability can be accomplished through the use of various controller configurations including but not limited to multi-channel power amplifiers and multi-module power amplifiers. In either case a single channel or module can be used to control a single unique physical thermal unit. In various embodiments, unique physical thermal units can be combined to form virtual channels. Virtual channels can be formed by selectively controlling multiple physical channels or modules to the same temperature setpoint to thermally control multiple thermal units. For example, a controller can have six physical channels or modules. A six channel or module controller can combine unique physical thermal units into different sized virtual channels capable of providing a substantially uniform temperature across different sized sample blocks. In various embodiments, for example, six physical channels or modules can be used to provide substantially uniform temperature across a 96 well sample block configured as an 8×12 well rectangular array. In various embodiments the six physical channels or modules can be combined to form 2 virtual channels each virtual channel being the combination of 3 adjacent physical channels or modules. Such a configuration can provide a substantially uniform temperature across two 48 well sample blocks or two 96 well sample blocks. In various embodiments each 48 well sample block can be configured as an 8×6 rectangular well array. In various embodiments each 48 well sample block can be configured as 4×12 well rectangular well array. In various embodiments the six physical channels or modules can be combined to form three virtual channels. Such a configuration can provide a substantial uniform temperature across three 32 well sample blocks. In various embodiments each 32 well sample block can be configured as a 4×8 rectangular well array. It should be understood that the number of physical channels or modules is not limited to six, and that any number of channels or modules either greater than six or less than six are included in the present teachings.

According to various embodiments a thermocycler system can include a thermal block assembly and a base unit configured with a controller. In various embodiments the thermal block assembly can be removable from the base unit and replaced with a different thermal block assembly. Each thermal block assembly can be configured with a different sample block format. Sample block formats can be configured with different numbers of sample wells including but not limited to 16 wells, 32 wells, 48 wells, 96 wells or 384 wells.

In various embodiments the format of the sample block can be encoded in the sample block assembly. Encoding implementations including, but not limited to, hardware jumpers, resistive terminators, pull-up resistors, pull-down resistors or data written to a memory device can provide suitable encoding. In various embodiments the encoded sample block format can be communicated to the base unit and controller or to an externally connected computer device.

According to various embodiments the base unit or external computer device can be capable of decoding the block format communicated from the sample block assembly. In various embodiments the base unit or external computer device can be capable of determining what virtual channel configuration corresponds to the sample block format. In various embodiments the controller can combine the physical channels of the controller appropriately to result in the required virtual channel configuration.

In step 1306, the temperature of each of the thermal units can be independently controlled with a controller to maintain a substantially uniform temperature throughout the sample block. In various embodiments, the controller can be a multi-channel controller, similar to what has previously been described above. In various embodiments, the controller can be a multi-module controller, also similar to what has been described above.

Experimental Data

As discussed above, an industry standard set in comparison with gel data, expresses TNU as either a difference of about 1.0° C., or an average difference of 0.5° C. The TNU values are calculated values based on sample block temperature measurements. In various embodiments temperature measurements are acquired from a set of thermal sensors located in specific wells of a sample block. In various embodiments the specific well locations of the sensors in the sample block are determined during the design phase of the sample block assembly and can represent the regions of the sample block that are most thermally diverse. As presented previously the temperature measurements are acquired through the use of a protocol (procedure) that can be resident on a hand held device or other computing device either of which is capable of executing machine-code. In various embodiments the protocol (procedure) can include thermal cycling parameters such as setpoint temperatures and dwell (hold) times. In various embodiments the thermal measurements can be taken during the transition (ramp) from one setpoint temperature to a second setpoint temperature to determine a dynamic TNU. In another embodiment the thermal measurements can be taken during the dwell (hold) time to determine a static TNU. In either case, the protocol (procedure) can include at what point in the dwell (hold) time or transition (ramp) time a measurement would be read.

For example, a TNU protocol can specify taking temperature measurements while cycling sample block temperatures between 95° C. and 60° C. The protocol can further specify the measurements being taken 30 seconds after the hold time or dwell time begins. At each temperature and time period all sensors in the fixture are read, and the results are stored in a memory.

The TNU is then calculated from the temperature readings obtained from the sensors. There are multiple methods of analyzing the temperature data. For example, one method for calculating TNU can involve identifying the warmest temperature and the coolest temperature recorded from all the sensors at a specific temperature point, for example 95° C. and 60° C. In various embodiments static TNU can be measured 30 seconds after the sample block reaches the setpoint temperature. The TNU can then be calculated by subtracting the coolest temperature from the warmest temperature. This method can be referred to as the difference TNU.

Another example of calculating TNU can involve identifying the warmest temperature and the coolest temperature recorded from all the sensors at a specific temperature point, for example 95° C. and 60° C. In various embodiments static TNU can be measured 30 seconds after the sample block reaches the setpoint temperature. The TNU can then be calculated by subtracting the coolest temperature from the warmest temperature, and then dividing the difference by two. This method can be referred to as the average difference TNU.

It should be noted that the TNU calculated from the sample block temperature measurements is not independent from setpoint temperature. As presented previously, heat loss from the sample block is greater when the temperature difference between the sample block and the ambient temperature is highest. A higher sample block setpoint, therefore, will inherently have a higher TNU. As a result, for example, the calculated TNU at a setpoint of 95° C. will be greater than the TNU calculated at a lower temperature, such as 60° C.

Also discussed above is that in certain system design configurations, thermal block assemblies can be subject to heat loss from the edges and corners of the sample block. Additionally the inclusion of open channel 32 in FIG. 3 can further result in insufficient and/or non-uniform distribution of heat being supplied throughout a sample block and contribute to a degradation of TNU performance. In various embodiments, this heat loss can be mitigated by including one or more edge heaters as an element of the sample block.

According to various embodiments, there are several examples of edge heaters commercially available. For example, Thermafoil™ Heater (Minco Products, Inc., Minneapolis, Minn.), HEATFLEX Kapton™ Heater (Heatron, Inc., Leavenworth, Kans.), Flexible Heaters (Watlow Electric Manufacturing Company, St. Louis, Mo.), and Flexible Heaters (Ogden Manufacturing Company, Arlington Heights, Ill.).

According to various embodiments, the edge heaters can be vulcanized silicone rubber heaters, for example Rubber Heater Assemblies (Minco Products, Inc.), SL-B Flexible-Silicone Rubber Heaters (Chromalox, Inc., Pittsburgh, Pa.), Silicone Rubber Heaters (TransLogic, Inc., Huntington Beach, Calif.), Silicone Rubber Heaters (National Plastic Heater Sensor & Control Co., Scarborough, Ontario, Canada).

According to various embodiments, the edge heater can be coupled to the edge surface with a variety of pressure sensitive adhesive films. It is desirable to provide uniform thickness and lack of bubbles. Uniform thickness provides uniform contact and uniform heating. Bubbles under the edge heater can cause localized overheating and possible heater burnout. Typically, pressure-sensitive adhesives cure at specified temperature ranges. Examples of pressure-sensitive adhesive films include Minco #10, Minco #12, Minco #19, Minco #17, and Ablefilm 550k (AbleStik Laboratories, Rancho Dominguez, Calif.).

According to various embodiments, the edge heater can be coupled to the edge surface with liquid adhesives. Liquid adhesives are better suited for curved surfaces than pressure sensitive adhesives. Liquid adhesives can include 1-part pastes, 2-part pastes, RTV, epoxies, etc. Bubbles can substantially be avoided by special techniques such as drawing vacuum on the adhesive after mixing, or perforating heaters to permit the bubbles to escape. Examples of liquid adhesives include Minco #6, GE #566 (GE Silicones, Wilton, Conn.), Minco 25 #15, Crest 3135 AlB (Lord Chemical, Cary, N.C.).

According to various embodiments, the edge heater can be coupled to the edge surface by tape or shrink bands. Shrink bands can be constructed of Mylar or Kapton. Instead of an intermediate adhesive layer, the adhesive layer is moved to the top of the pasting heater. Examples of shrink bands and stretch tape include Minco BM3, Minco BK4, and Minco #20. According to various embodiments, the pasting heater can be laminated onto the edge surface, for example by films. According to various embodiments, edge heaters can be mechanically attached to the heating surface. For example, an edge heater with eyelets have be attached with a lacing cord, Velcro hooks and loops, metallic fasteners with springs, and independent fasteners with straps.

According to various embodiments, the heat supplied by an edge heater can be uniformly distributed or non-uniformly distributed. In various embodiments a non-uniform heat distribution can be more effective to compensate for non-uniform heat loss from a sample block to ambient as presented previously. The non-uniform heat loss can result from the corners of the sample block losing heat more rapidly than the longer edges of the sample block. In various embodiments non-uniform heat distribution can be provided by varying the heat density throughout the edge heater. This technique can, for example, compensate for non-uniform heat loss between the edges of a sample block and the corners as presented above.

According to various embodiments the heat distribution can be such that heat can be applied to specific areas of the block and no heat provided to other areas. This technique can, for example, compensate for features or regions of a sample block assembly that can be void of a heat source.

According to various embodiments one or more edge heaters can be used as presented above. Depending on the heat required, an edge heater can be affixed to one edge of a sample block. An additional edge heater can be affixed to an opposing edge surface or an adjacent edge surface of the sample block or both edge surfaces.

According to various embodiments individual edge heaters can be affixed to any or all four edge surfaces of a rectangular sample block. The use of multiple edge heaters can enable independent control of each edge heater to compensate for varying heat loss from the sample block during the execution of a thermal protocol (or procedure).

These effects are illustrated in the thermal plots shown in FIGS. 12 and 13. In FIGS. 12 and 13 a set of thermal plots depicts the thermal non-uniformity (TNU) performance profile of a sample block assembly using thermal data measured from a thermal block assembly similar to what is shown in FIG. 8.

FIG. 12 is a set of thermal plots depicting the thermal non-uniformity (TNU) performance profile of a dual 96-well sample block assembly without integrated edge heating elements, in accordance with various embodiments. The four thermal surface plots shown in FIG. 12 are well known in the art and can be generated through the use of any number of software programs such as Microsoft Excel. The surface plots represent the temperature throughout a sample block (without edge heaters) under a specific set of conditions. By way of example, the surface plots of FIG. 12 can represent the thermal profiles of the two sample blocks shown in FIG. 8. Surface plots 1110 and 1120 depict the TNU profiles of sample blocks 810 and 820 respectively at an up ramp temperature setting of about 95° C. Surface plots 1130 and 1140 represent the TNU of sample blocks 810 and 820 respectively at a down ramp temperature setting of about 60° C. For surface plots 1110 through 1140, the TNU was calculated according to the average difference method discussed above. That is, as shown in the thermal plots of FIG. 12, the TNU of the sample blocks (without edge heaters) during an up ramp operation to 95° C. is between about 0.43° C. to about 0.53° C. During a down ramp operation to 60° C., the TNU of the blocks is between about 0.35° C. to about 0.46° C.

Surface plot 1110 shows a slope in temperature on the left side of the plot while Surface plot 1120 shows a slope in temperature on the right side. One skilled in the art, by referring to FIG. 9, will recognize that the downward slopes shown on surface plots 1110 and 1120 corresponds approximately to the locations of the open channels defined on the Peltier device underneath the sample block. This effect can also be observed in surface plots 1130 and 1140. The effect, however, is not as prominent in surface plots 1130 and 1140, since the temperature difference between the sample block temperature set-point and ambient is much smaller.

FIG. 13 is a set of thermal plots depicting the thermal non-uniformity (TNU) performance profile of a dual 96-well sample block assembly with integrated edge heating elements, in accordance with various embodiments. Four surface plots 1210, 1220, 1230 and 1240 are depicted in FIG. 13. Similar to FIG. 12, surface plots 1210 and 1220 represent the TNU of sample blocks 810 and 820 respectively at an up ramp temperature setting of about 95° C. Surface plots 1230 and 1240 represent the TNU of sample blocks 810 and 820 respectively at a down ramp temperature setting of about 60° C. Similar to the surface plots of FIG. 12, the TNU for surface plots 1210 through 1240 was also calculated according to the average difference method disclosed previously.

The surface plots of FIG. 13, however, are the result of an edge heater being coupled to the substantially flat edge surfaces of sample blocks 810 and 820 of FIG. 8. The coupling of an edge heater to each of blocks 810 and 820 can be accomplished similar to what is shown as edge heater 760 in FIG. 7. The edge heater is configured to provide additional heat to the sample block in the region of the open channels defined on the Peltier devices. The additional heat compensates for the lack of Peltier elements in the open channel, while maintaining the capability of the thermal block assembly to individually control each of the Peltier devices.

One skilled in the art will notice that the inclusion of the edge heater has a positive effect for both the TNU at the high temperature and the TNU at the low temperature. Additionally, by comparing the surface plots of FIG. 12 to the surface plots of FIG. 13, one will also recognize that the inclusion of the edge heaters provides an overall improvement to the TNU of both sample blocks. The resulting TNUs shown in FIG. 13 is almost a factor of 2 better than the industry standard for the average difference method of 0.5° C. that was previously disclosed in FIG. 12. That is, as shown in the thermal plots of FIG. 13, the TNU (calculated using an average difference method) of the blocks during an up ramp operation to 95° C. is between about 0.26° C. and 0.28° C. During a down ramp operation to 60° C., the TNU of the blocks is between about 0.24° C. to about 0.29° C.

FIG. 16 is a set of thermal plots depicting the thermal non-uniformity (TNU) performance profile of a dual 96-well sample block assembly with integrated edge heating elements for a sample block assembly representative of the conventional art. Four surface plots 1610, 1620, 1630 and 1640 are depicted in FIG. 16. Surface plots 1610 and 1620 represent the TNU of sample blocks similar to sample blocks 810 and 820 respectively at an up ramp temperature setting of about 95° C. Surface plots 1630 and 1640 represent the TNU of sample blocks similar to sample blocks 810 and 820 respectively at a down ramp temperature setting of about 60° C. The sample blocks used in creating surface plots 1610 to 1640, however, differ from sample blocks 810 and 820 of FIG. 8. The sample blocks of FIG. 16 include thermoelectric devices void of open channel 750 of FIG. 7 and are therefore incapable of independent discrete thermal control of the individual thermoelectric devices. Similar to the surface plots of FIG. 13, the TNU for surface plots 1610 through 1640 were also calculated according to the average difference method disclosed previously.

Similar to the surface plots of FIG. 13, surface plots 1610 through 1640, are the result of an edge heater being coupled to the substantially flat edge surfaces of sample blocks similar to sample blocks 810 and 820 of FIG. 8. The coupling of an edge heater to each of blocks 810 and 820 can be accomplished similar to what is shown as edge heater 760 in FIG. 7.

One skilled in the art will notice that the inclusion of the thermoelectric devices with the open channel which enables the capability of independent discrete thermal control of the thermoelectric devices has a positive effect for both the TNU at the high temperature and the TNU at the low temperature. Additionally, by comparing the surface plots of FIG. 13 to the surface plots of FIG. 16, one will also recognize that the inclusion of the thermoelectric devices with the open channel provides an overall improvement to the TNU of both sample blocks. The resulting TNU shown in FIG. 13 shows almost a 45% improvement in TNU as compared to the TNU for the sample blocks of FIG. 16 of the conventional art without an open channel in the thermoelectric devices. That is, as shown in the thermal plots of FIG. 13, the TNU (calculated using an average difference method) of the blocks during an up ramp operation to 95° C. is between about 0.26° C. and 0.28° C. as compared to the TNU (calculated using an average difference method) of the blocks of FIG. 16 during an up ramp operation to 95° C. which is between about 0.47° C. and 0.49° C. During a down ramp operation to 60° C., the TNU of the blocks of FIG. 13 is between about 0.24° C. to about 0.29° C. as compared to the TNU (calculated using an average difference method) of the blocks of FIG. 16 during a down ramp operation to 60° C. which is between about 0.41° C. and 0.43° C. It should also be noted that the TNU for both FIG. 13 and FIG. 16 is lower at the setpoint of about 60° C. than the setpoint of about 95° C. for reasons previously presented. This marked improvement in TNU profile due to including edge heating elements onto a sample block is similarly pronounced when looking at the thermal plots of FIG. 14 and FIG. 15 for a dual-flat configuration sample block assembly.

FIG. 14. is a set of thermal plots depicting the thermal non-uniformity (TNU) performance profile of a dual flat-block sample block assembly without integrated edge heating elements, in accordance with various embodiments. As shown in the thermal plots for FIG. 14, the TNU (calculated using an average difference method) of the blocks during an up ramp operation to 95° C. is between about 0.62° C. to about 0.73° C. During a down ramp operation to 60° C., the TNU of the blocks is between about 0.17° C. to about 0.23° C.

FIG. 15. is a set of thermal plots depicting the thermal non-uniformity (TNU) performance profile of a dual flat-block sample block assembly with integrated edge heating elements, in accordance with various embodiments. As shown in the thermal plots for FIG. 14, the TNU (calculated using an average difference method) of the blocks during an up ramp operation to 95° C. is between about 0.24° C. to about 0.32° C. During a down ramp operation to 60° C., the TNU of the blocks is between about 0.15° C. to about 0.22° C.

While the foregoing embodiments have been described in some detail for purposes of clarity and understanding, it will be clear to one skilled in the art from a reading of this disclosure that various changes in form and detail can be made without departing from the true scope of the invention. For example, all the techniques, apparatuses and systems described above can be used in various combinations.

The invention claimed is:

1. A thermal block assembly, comprising:

a sample block comprising a top surface configured to receive a plurality of reaction vessels, and a bottom surface on an opposite face of the sample block from the top surface;

two or more thermoelectric devices in thermal communication with the sample block, wherein each thermoelectric device comprises:

a first thermally conductive layer and a second thermally conductive layer, a plurality of Peltier elements between the first and second thermally conductive layers, and a recess extending into the plurality of Peltier elements from a perimeter of the thermoelectric device;

two or more thermal sensors, a thermal sensor of the two or more thermal sensors received in each recess; and a controller operably coupled to the two or more thermoelectric devices and configured to operate the two or more thermoelectric devices independently from each other to provide a substantially uniform temperature profile throughout the sample block.

2. The thermal block assembly of claim 1, wherein the first thermally conductive layer of each thermoelectric device is in thermal communication with the bottom surface of the sample block and the second thermally conductive layer of each thermoelectric device has a surface facing away from the sample block.

3. The thermal block assembly of claim 2, wherein the recess is formed by a carved-out portion of one or both of the first and second thermally conductive layers.

4. The thermal block assembly of claim 1, wherein the thermal sensor is selected from a thermocouple, a thermistor, a platinum resistance thermometer, and a silicon bandgap temperature sensor.

5. The thermal block assembly of claim 1, wherein the controller is operably connected to the thermal sensor in each recess and configured to independently control the two or more thermoelectric devices in response to information received from each thermal sensor.

6. The thermal block assembly of claim 1, wherein the controller comprises two or more independent controllers.

7. The thermal block assembly of claim 1, further comprising a heat sink, wherein:

the heat sink comprises a baseplate and fins, wherein the baseplate is in thermal communication with the two or more thermoelectric devices, and the fins extend from the baseplate in a direction away from the two or more thermoelectric devices.

8. The thermal block assembly of claim 1, wherein the recess of each thermoelectric device is surrounded by a portion of the plurality of Peltier elements of each thermoelectric device.

9. The thermal block assembly of claim 1, further comprising a heating element disposed proximate a peripheral edge of the sample block.

10. The thermal block assembly of claim 9, wherein the heating element is disposed proximate the recess.

11. The thermal block assembly of claim 1, wherein each thermoelectric device comprises a wall at the perimeter, the recess extending through the wall into the thermoelectric device.

12. A method for controlling sample block temperature, comprising:

transferring heat between a sample block and two or more thermoelectric devices, the sample block comprising a top surface configured to receive a plurality of reaction vessels, and a bottom surface on an opposite face of the sample block from the top surface, each thermoelectric device comprising:

a first thermally conductive layer and a second thermally conductive layer, a plurality of Peltier elements between the first and second thermally conductive layers, and a recess extending into the plurality of Peltier elements from a perimeter of the thermoelectric device;

sensing temperatures of the sample block using two or more thermal sensors, a thermal sensor of the two or more thermal sensors received in each recess; and using a controller to independently control a temperature of each thermoelectric device using the temperatures sensed to maintain a substantially uniform temperature throughout the sample block.

13. The method of claim 12, further comprising using the controller, controlling each thermoelectric device to minimize temperature differences sensed by each thermal sensor.

14. The method of claim 13, wherein each thermal sensor is configured to measure temperature of a sample block region that is proximate to each respective thermal sensor.

15. The method of claim 12, wherein the controller is comprised of two or more sub-controllers.

16. The method of claim 15, wherein each of the sub-controllers is operably connected to one thermoelectric device.

* * * * *